US006643858B2

(12) United States Patent
Lee

(10) Patent No.: US 6,643,858 B2
(45) Date of Patent: Nov. 11, 2003

(54) PREFABRICATED SWIMMING POOL

(75) Inventor: Jae Hyong Lee, Jaechun (KR)

(73) Assignee: Portable Pools Incorporated, Jaechun (KR)

( * ) Notice: Subject to any disclaimer, the term of this patent is extended or adjusted under 35 U.S.C. 154(b) by 0 days.

(21) Appl. No.: 09/983,640

(22) Filed: Oct. 25, 2001

(65) Prior Publication Data

US 2002/0042948 A1 Apr. 18, 2002

Related U.S. Application Data

(62) Division of application No. 09/567,230, filed on May 9, 2000.

(30) Foreign Application Priority Data

May 10, 1999 (KR) ..... 1999/16629
Feb. 23, 2000 (KR) ..... 2000/8698

(51) Int. Cl.[7] ..... E04H 4/00
(52) U.S. Cl. ..... 4/506; 52/169.7
(58) Field of Search ..... 4/506; 220/4.16, 220/648; 52/169.7

(56) References Cited

U.S. PATENT DOCUMENTS

| | | | | |
|---|---|---|---|---|
| 1,664,887 A | * | 4/1928 | Kirkham et al. | 4/506 X |
| 4,356,933 A | | 11/1982 | Connolly | 4/506 X |
| 5,083,327 A | | 1/1992 | Gillebaard | 4/506 |
| 5,592,702 A | | 1/1997 | Gillebaard, Jr. | 4/506 |

FOREIGN PATENT DOCUMENTS

| | | | | |
|---|---|---|---|---|
| FR | 273910 | * | 3/1951 | 4/506 |
| GB | 0767621 | | 2/1957 | 4/506 |
| GB | 1594430 | * | 7/1981 | 4/506 |
| SU | 478106 | * | 8/1975 | 4/506 |

* cited by examiner

*Primary Examiner*—Gregory Huson
*Assistant Examiner*—Amanda Flynn
(74) *Attorney, Agent, or Firm*—Oliff & Berridge, PLC

(57) ABSTRACT

A prefabricated swimming pool including a pool frame having a plurality of vertical frames and horizontal frames connected between the vertical frames, and pool body fabricated from a synthetic resin sheet having a base unit and a circumferential side wall and supported by the pool frame. Storing and carrying of the swimming pool is simple and handy, and there is no possibility that the circumferential side wall is inclined or collapses, ensuring a safe and stable use.

8 Claims, 29 Drawing Sheets

PREFABRICATED SWIMMING POOL

This is a division of application Ser. No. 09/567,230, filed May 9, 2000.

BACKGROUND OF THE INVENTION

1. Field of the Invention

The present invention relates to prefabricated swimming pools, and more particularly, to a prefabricated swimming pool that enables a simple and easy assembling and storing as well as ensuring a safe use.

2. Description of the Background Art

Conventionally, various kinds of prefabricated portable swimming pools have been introduced, including a large box-shaped single body type swimming pool and an inflatable swimming pool made in a rubber tube that is inflated to a predetermined form by injecting air.

However, the prefabricated swimming pool made in a single body is disadvantageous in that due to its fixed volume, it requires a large space and is inconvenient to carry and handle. Meanwhile, in case of the inflatable swimming pool, in spite of its advantages that it can be kept in a small space and handy in carrying, it has drawbacks that its circumferential side wall may be inclined or collapse, resulting in that water filled therein readily flows out to dampen the surroundings, and especially, may damage stuffs weak to water.

SUMMARY OF THE INVENTION

Therefore, an object of the present invention is to provide a prefabricated swimming pool that can be stored in a small space, handy in carrying as well as being used stably without being inclined or collapsing of the circumferential side wall.

To achieve these and other advantages and in accordance with the purpose of the present invention, as embodied and broadly described herein, there is provided a prefabricated swimming pool comprising: a pool frame having a plurality of vertical frames, a plurality of horizontal frames of which both ends are positioned at the upper ends of the plurality of vertical frames; connectors having a vertical portion inserted at the upper end portion of the vertical frame and a horizontal portion inserted at the end portion of the horizontal frame, and support caps combined at the lower end portion of the vertical frame; and a pool body having a base unit, a circumferential side wall upwardly extended from the marginal portion of the base unit, a pocket unit formed at the upper end of the circumferential side wall, into which the horizontal frame is inserted, and a plurality of support pieces extendedly formed between the marginal portion of the base unit and the lower end of the circumferential side wall and having an insert hole into which the support cap is inserted.

In order to achieve the above object, there is also provided a prefabricated swimming pool comprising: a pool frame having a plurality of vertical frames, a plurality of upper and lower horizontal frames of which both ends are positioned at the upper and lower ends of the plurality of vertical frames; connectors having a vertical portion inserted at the upper end portion of the vertical frame and a horizontal portion inserted at the end portion of the horizontal frame and a pool body having a base unit, a circumferential side wall upwardly extended from the marginal portion of the base unit, a pocket unit formed at the upper end of the circumferential side wall, into which the horizontal frame is inserted.

In order to achieve the above object, there is also provided a prefabricated swimming pool comprising: a pool frame having a plurality of vertical frames, a plurality of horizontal frames of which both ends are positioned at the upper end of the vertical frame, and connectors consisting of a bolt bar protrusively formed at the upper end of the vertical frame, a connection piece protrusively formed at both ends of the horizontal frame and having a through hole into which the bolt bar is penetrated, and a nut engaged with the protruded end of the bolt bar penetrated through the through hole; and a pool body having a base unit, a circumferential side wall upwardly extended from the marginal portion of the base unit, a pocket unit formed at the upper and lower ends of the circumferential side wall, into which the horizontal frame is inserted.

In order to achieve the above object, there is also provided a prefabricated swimming pool comprising: a pool frame having a plurality of vertical frames, a plurality of horizontal frames of which both ends are positioned at the upper and lower ends of the vertical frames, and connectors consisting of a bolt bar protrusively formed at the upper end of the vertical frame, a connection piece protrusively formed at both ends of the horizontal frame and having a through hole into which the bolt bar is penetrated, and a nut engaged with the protruded end of the bolt bar penetrated though the through hole; and a pool body having a base unit, a circumferential side wall upwardly extended from the marginal portion of the base unit, a pocket unit formed at the upper and lower ends of the circumferential side wall, into which the horizontal frame is inserted.

In order to achieve the above object, there is also provided a prefabricated swimming pool comprising: a pool body having a base unit, a circumferential side wall upwardly extended from the marginal portion of the base unit, and a plurality of pockets formed at the upper end of the circumferential side wall, the pockets being divided by a plurality of opening portions; and a pool frame having an upper horizontal frame consisting of a plurality of upper horizontal bars inserted to the pocket of the pool body and upper horizontal connectors connecting the adjacent upper horizontal bars, a lower horizontal frame, corresponding to the upper horizontal frame, consisting of a plurality of lower horizontal bars placed on the ground and lower horizontal connectors connecting the adjacent lower horizontal bars, and a plurality of vertical frames being disposed at the exterior of the circumferential side wall and connecting the upper horizontal bars and the lower horizontal bars.

In order to achieve the above object, there is also provided a prefabricated swimming pool comprising: a pool body having a base unit, a circumferential side wall upwardly extended from the marginal portion of the base unit, and a plurality of pockets formed at the upper end of the circumferential side wall, the pockets being divided by opening portions formed at the corner portion; and a pool frame having a horizontal frame consisting of a horizontal bar and a linear connection bar respectively inserted and mutually connected in the pocket and a corner connection bar connecting the horizontal bars at the corner portion, and a vertical frame consisting of a support unit placed on the ground at the exterior of the circumferential side wall and a vertical unit upwardly extended from both the inner sides of the support unit so that the upper end thereof is combined with the horizontal bar.

In order to achieve the above object, there is also provided a prefabricated swimming pool comprising: a pool body having a base unit, a circumferential side wall upwardly extended from the marginal portion of the base unit, and a plurality of pockets formed at the upper end of the circumferential side wall, the pockets are being divided by opening portions formed at the corner portions; and a pool frame having a horizontal frame consisting of a plurality of horizontal bars inserted and mutually connected in the pocket and a corner connection bar connecting the horizontal bars at the corner portion, and a vertical frame consisting of a support unit placed on the ground at the exterior of the circumferential side wall and a vertical bar upwardly extended from the outer end of the support unit so that its upper end is combined with the horizontal bar.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 1 through 6 illustrate a prefabricated swimming pool in accordance with a first embodiment of the present invention, of which FIG. 1 is a perspective view of the prefabricated swimming pool;

FIG. 2 is a partial enlarged view of a pool frame and a pool body;

FIG. 3 is an enlarged disassembled perspective view of the pool frame;

FIG. 4 is a disassembled front view of a vertical frame and a divided horizontal frame; and FIGS. 5 and 6 are front views illustrating assembling of the divided horizontal frame;

FIGS. 8 through 10 illustrate a prefabricated swimming pool in accordance with a second embodiment of the present invention, of which FIG. 8 is a perspective view of the prefabricated swimming pool;

FIG. 9 is a partial enlarged view of a pool frame and a pool body; and

FIG. 10 is an enlarged disassembled perspective view of the pool frame;

FIGS. 11 through 13 illustrate a prefabricated swimming pool in accordance with a third embodiment of the present invention, of which FIG. 11 is a perspective view of the prefabricated swimming pool;

FIG. 12 is a partial enlarged view of a pool frame and a pool body; and

FIG. 13 is an enlarged disassembled perspective view of the pool frame;

FIGS. 14 through 16 illustrate a prefabricated swimming pool in accordance with a fourth embodiment of the present invention, of which FIG. 14 is a perspective view of the prefabricated swimming pool;

FIG. 15 is a partial enlarged view of a pool frame and a pool body; and

FIG. 16 is an enlarged disassembled perspective view of the pool frame;

FIGS. 17 through 21 illustrate a prefabricated swimming pool in accordance with a fifth embodiment of the present invention, of which FIG. 17 is a perspective view of an overall assembly;

FIG. 18 is a partial enlarged perspective view of FIG. 17;

FIG. 19 is a partial disassembled perspective view of a pool frame;

FIG. 20 is a partial disassembled exploded view of the pool frame; and

FIG. 21 is a partial enlarged sectional view showing a coupling structure of an upper horizontal frame and a vertical frame;

FIGS. 22 through 26 illustrate a prefabricated swimming pool in accordance with a sixth embodiment of the present invention, of which FIG. 22 is a perspective view of an overall assembly;

FIG. 23 is a partial enlarged perspective view of FIG. 22;

FIG. 24 is a partial disassembled perspective view of a pool frame;

FIG. 25 is a disassembled perspective view of a vertical frame; and

FIG. 26 is a partial enlarged sectional view showing an assembled state of a support unit of the vertical frame;

FIGS. 27 through 32 illustrate a prefabricated swimming pool in accordance with a seventh embodiment of the present invention, of which FIG. 27 is a perspective view of an overall assembly;

FIG. 28 is a partial enlarged perspective view of FIG. 27;

FIG. 29 is a partial disassembled perspective view of a pool frame;

FIG. 30 is a partial disassembled front view of the pool frame;

FIG. 31 is a partial disassembled perspective view of a vertical frame; and

FIG. 32 is a partial enlarged sectional view showing an assembled state of a horizontal frame, the vertical frame and the support unit

DETAILED DESCRIPTION OF THE PREFERRED EMBODIMENTS

Figure 1:
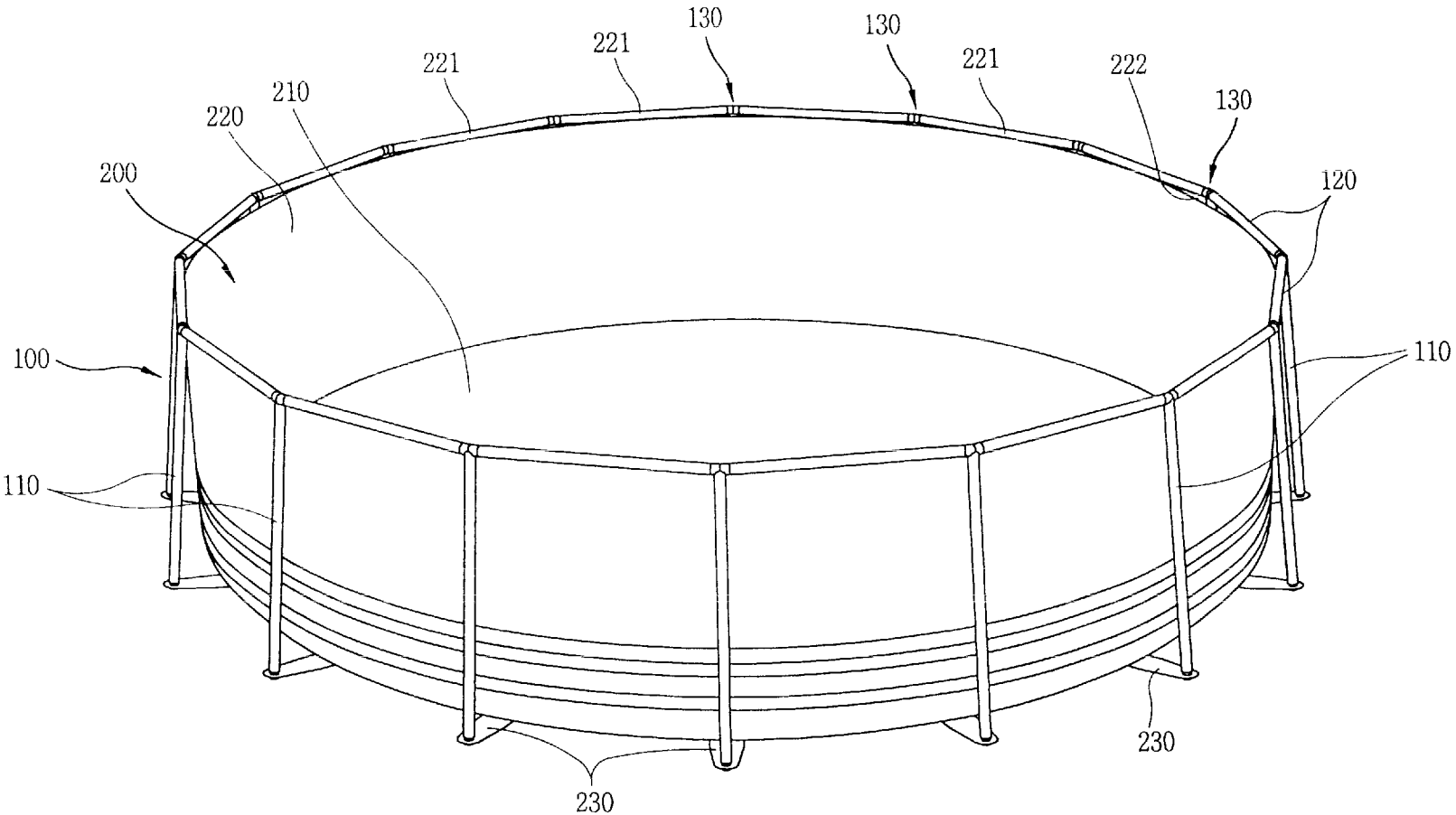
Figure 2:
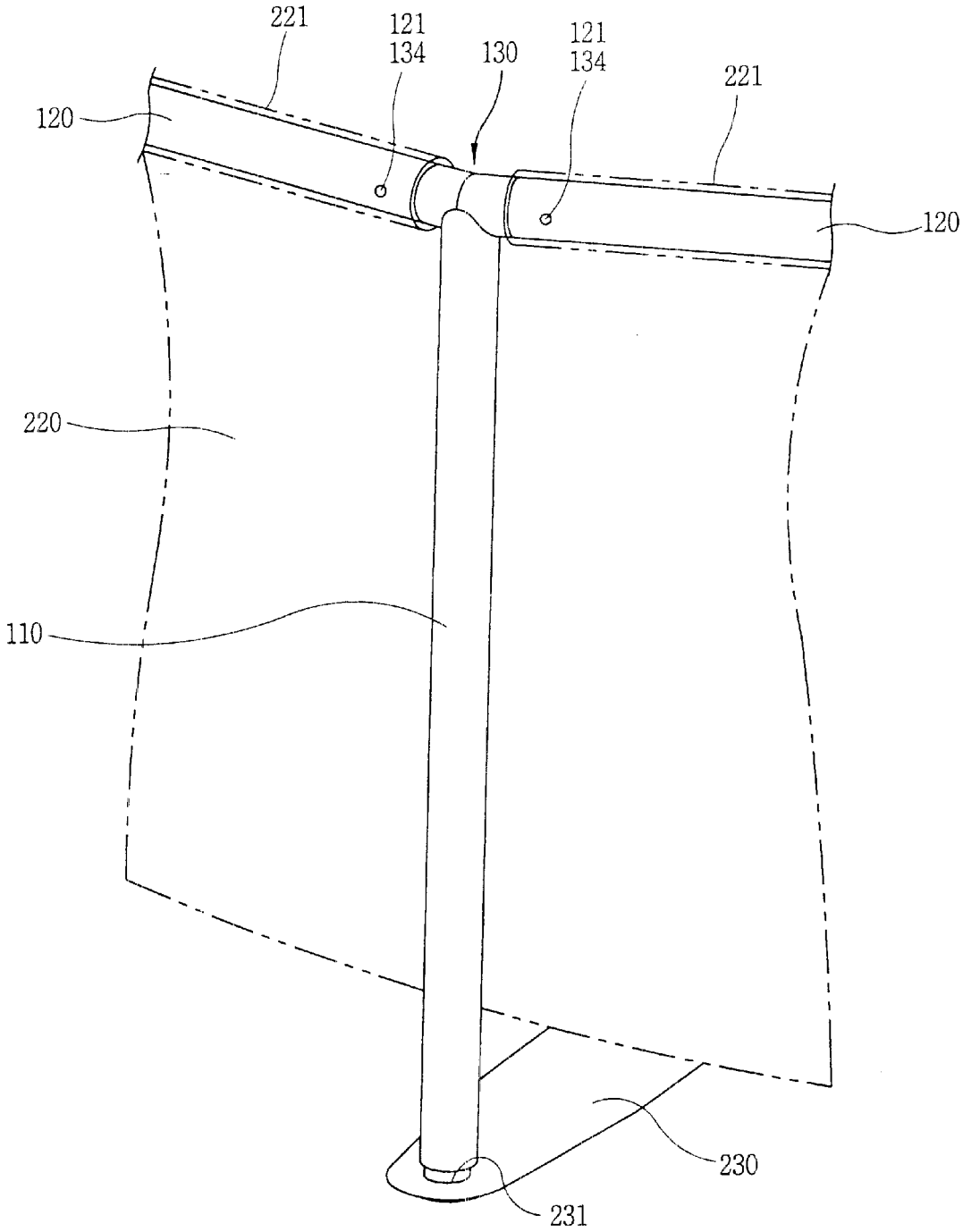
Figure 3:
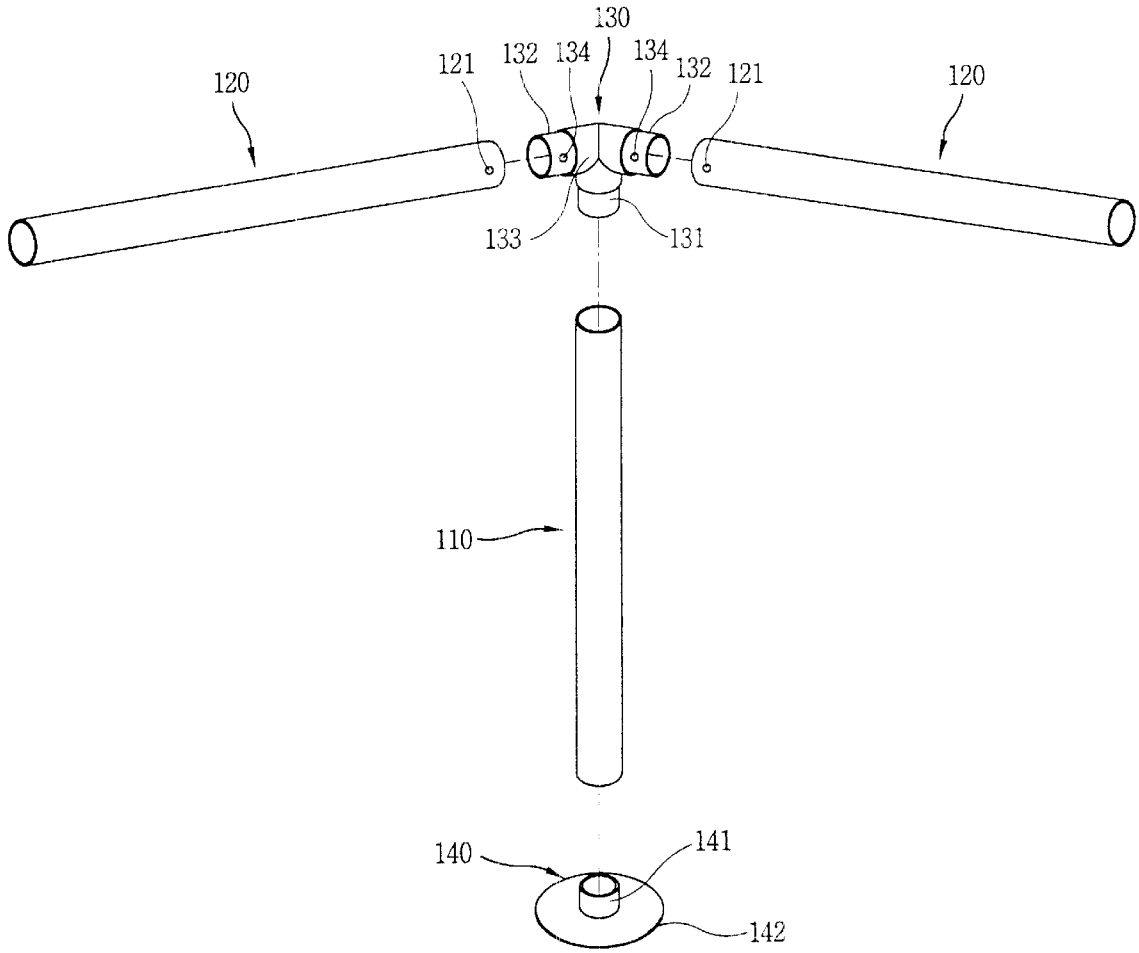
Figure 4:
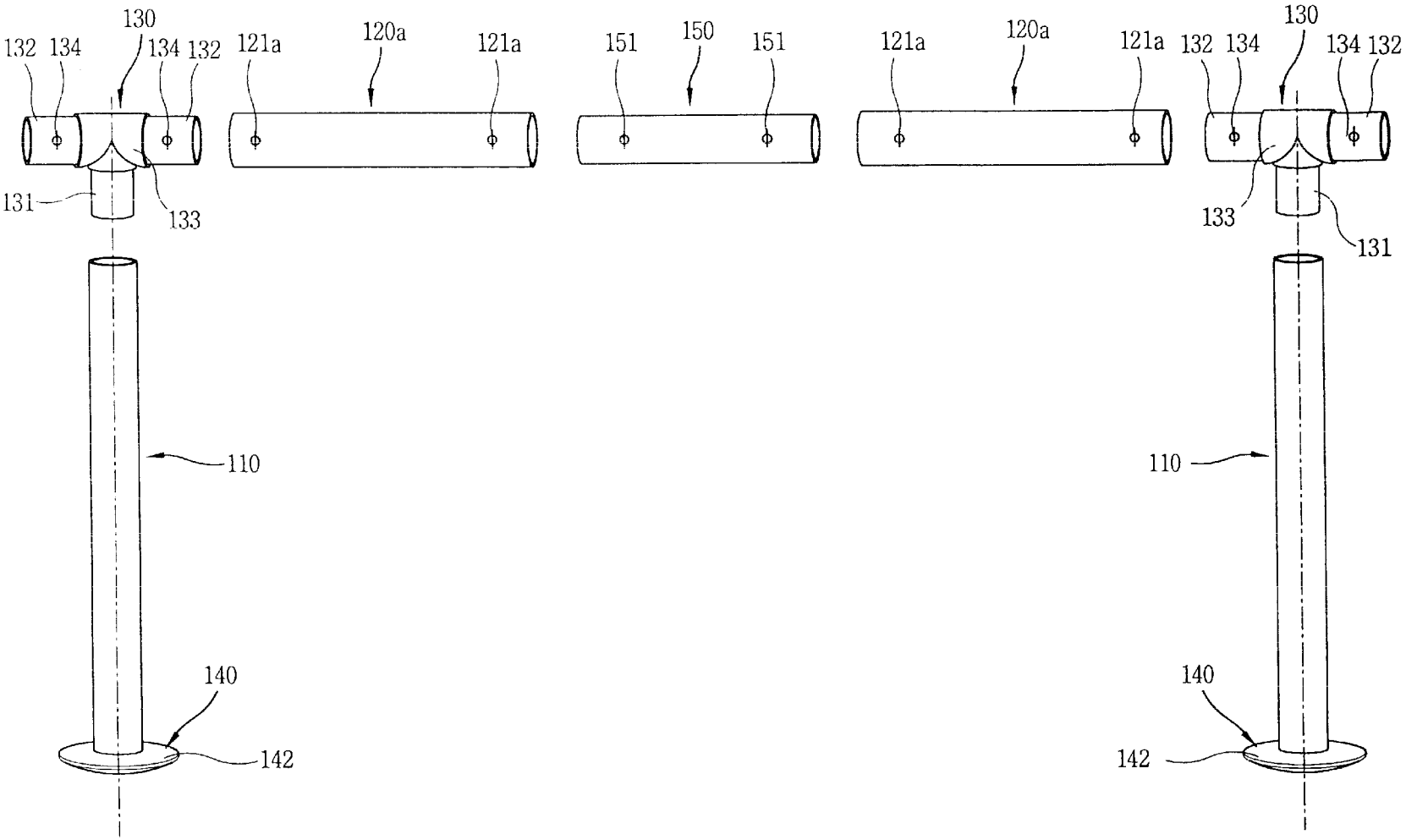
Figure 5:
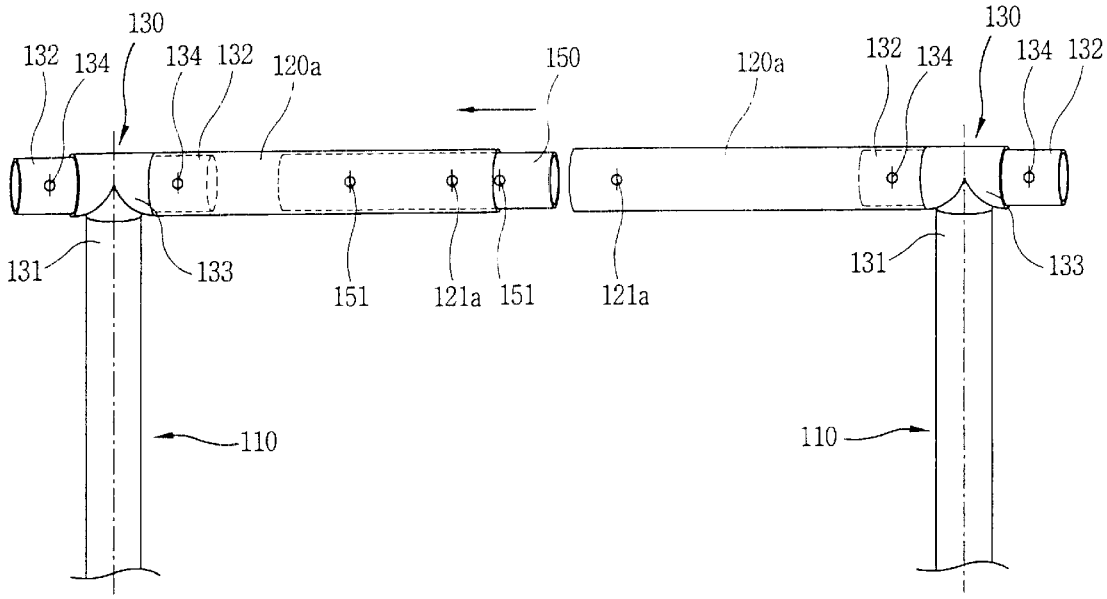
Figure 6:
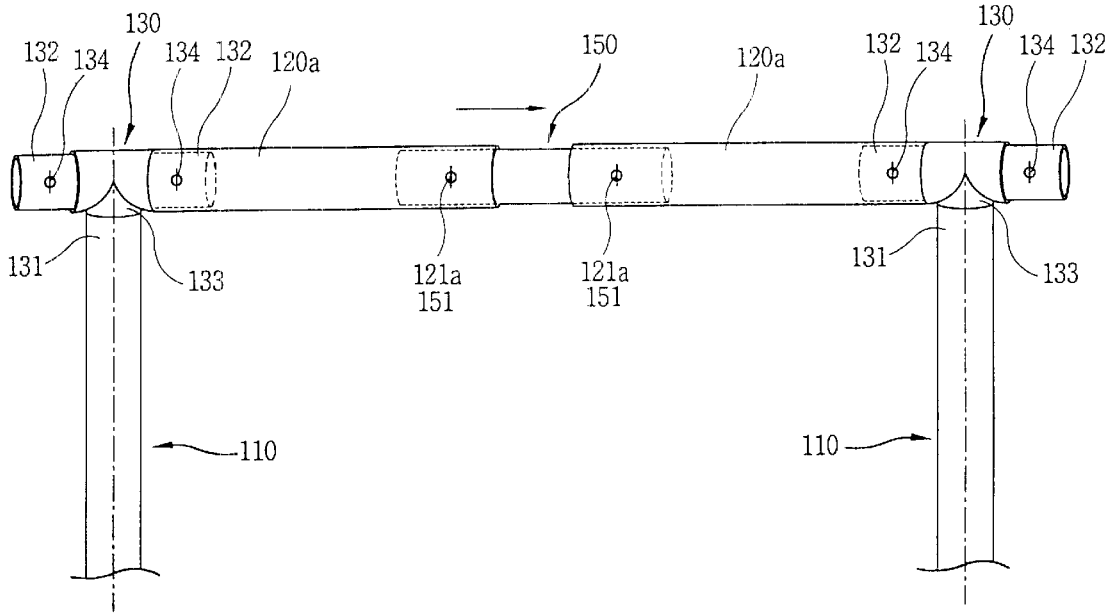

Reference will now be made in detail to the preferred embodiments of the present invention, examples of which are illustrated in the accompanying drawings. FIGS. 1 through 6 illustrate a prefabricated swimming pool in accordance with a first embodiment of the present invention, of which FIG. 1 is a perspective view of the prefabricated swimming pool; FIG. 2 is a partial enlarged view of a pool frame and a pool body; FIG. 3 is an enlarged disassembled perspective view of the pool frame; FIG. 4 is a disassembled front view of a vertical frame and a divided horizontal frame; and FIGS. 5 and 6 are front views illustrating assembling of the divided horizontal frame.

In the drawings, reference numeral 100 denotes a pool frame, and 200 denotes a pool body supported by the pool frame 100.

The pool frame 100 includes a plurality of vertical frames 110 and a horizontal frame 120 connecting the upper end of the vertical frames 110.

The vertical frame 110 and the horizontal frame 120 are formed of a hollow pipe, for which a circular pipe is preferably used but not limited thereto.

The upper end of the vertical frame 110 and the both-sided horizontal frame 120 to be connected to the upper ends of the vertical frame 310 are connected by a T-shaped connector 130.

As shown in FIG. 3, the T-shaped connector 130 includes a vertical portion 131 inserted into the upper end portion of the vertical frame 110 and a both-sided horizontal unit 132 to be inserted into the both end portions of the horizontal frame 120.

The plane form made by the pool frame 110 is determined depending on the number of the vertical frames 110 and the horizontal frames 120. On the assumption that the number is n, the plane form of the pool frame 100 is made by 180–360/n°, of which the angle of the both-sided horizontal unit 132 of the T-shaped connector 130 is the same as the angle made between adjacent horizontal frames 120.

For example, in case that there are 16 vertical frames 110 and 16 horizontal frames 120 in number, the angle of the both-sided horizontal unit 132 of the T-shaped connector 130 is 157.5°, respectively. Meanwhile, in case that there are 12 vertical frames 110 and 12 horizontal frames 120 in number, the angle therebetween would be 150°.

The number of the vertical frames 110 and the horizontal frames 120 is determined by the size of the pool, without being limited to 12 ones or 16 ones.

The vertical portion 131 and the both-sided horizontal unit 132 of the T-shaped connector 130 are formed to have an outer diameter for a convenience of insertion of slide fitting into the vertical frame 110 and into the horizontal frame 120.

The vertical portion 131 and the both-sided horizontal unit 132 of the T-shaped connector 130 may be combined by direct-welding, but it is preferred that a connection unit 133 having the same outer diameter as that of the horizontal frame 120 covers the both-sided horizontal unit 132 so that when the both-sided horizontal unit 132 is inserted into the horizontal frame 120, the outer circumferential surface of the horizontal frame 120 and that of the connection unit 133 make a uniformly connected circumferential surface.

Serving to help a fine view by making the outer circumferential surface of the horizontal frame 120 and that of the connection unit 133 to be a uniformly connected circumferential surface, the connection unit 133 also serves to define the connection position of the horizontal frame 120.

A fixing hole 121 is formed at both ends of the horizontal frame 120, penetrating the circumferential wall, and a fixing protrusion 134 is elastically protruded at the both end portions of the both-sided horizontal unit 132 of the T-shaped connector 130, corresponding to the fixing hole 121.

Normally, in order to render the fixing protrusion 134 to be protrusive elastically, an elastic member 135 is installed inside the both-sided horizontal unit 132 to elastically support the fixing protrusion 134.

Figure 7:
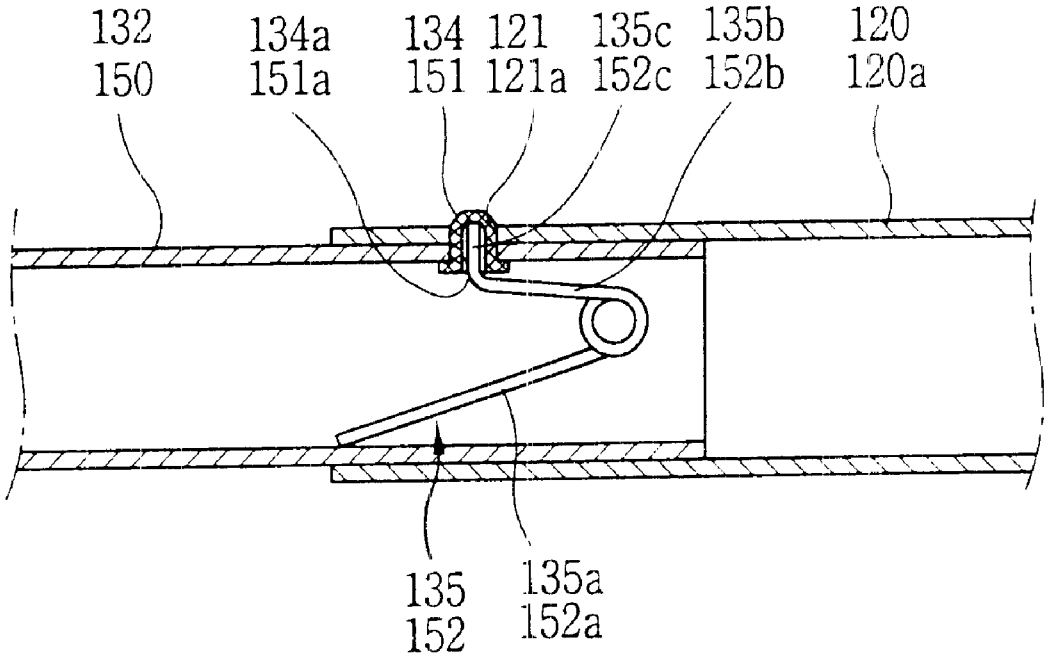
FIG. 7 is a sectional view showing a structure of a fixing protrusion installed at a T-shaped connector and at a straight line-shaped connector in accordance with the first embodiment of the present invention.

As the elastic member 135, a compressive coil spring may be used. Yet, to as shown in FIG. 7, in order to facilitate assembling, it is preferred to use a torsion spring consisting of a fixing support portion 135*a* supported by the inner circumferential surface of the horizontal frame 120 and an elastic support portion 135*b* supporting the fixing protrusion 134.

In order to prevent an arbitrary separation between the fixing protrusion 134 and the elastic support portion 135*b*, preferably, a fixing groove 134*a* is formed at the bottom of the fixing protrusion 134 and an insertion-fixing portion 135*c* is formed bent at the elastic support portion 135*b* so as to be insertedly fixed at the fixing groove 134*a*.

As shown in FIG. 4, a support cap 140 supported by the bottom surface is combined at the lower end portion of the vertical frame 110.

The support cap 140 includes an insertion part 141 inserted to the lower end portion of the vertical frame 110, and a disk-type support part 142 having the insertion part 141 attached at its upper central portion.

The insertion part 141 may be insertedly fixed to the lower end portion of the vertical frame 110 by force, or may be inserted in a manner of slide fitting and fixedly combined thereto by inserting a fixing pin penetrating the lower end portion of the circumferential wall side of the vertical frame 110 and the circumferential wall side of the insertion part 141.

Meanwhile, one of the horizontal frames 120 is divided to two divided horizontal frames 120*a* and 120*b*, which are to be connected by the straight line-shaped connector 150.

The divided horizontal frames 120*a* and 120*b* are formed shorter than the half the length of the horizontal frame 120. The reason for this is to smoothly connect the last nth horizontal frame 120 after the n-1th number of horizontal frames 120 are connected by the T-shaped connectors 130 with n number of horizontal frames 120.

As to the straight line-shaped connector 150, its left half portion and right half portion are respectively inserted into the divided horizontal frames 120*a* and 120*b*.

In this respect, the outer diameters of the left and right half portions are set to be slide-fitted into the divided horizontal frames 120*a* and 120*b*.

At the left and right half portions of the straight line-shaped connector 150, a fixing protrusion 151 is elastically formed protrusively, respectively.

At one end of the divided horizontal frames 120*a* and 120*b*, a fixing hole 121 is formed corresponding to the fixing protrusion 134 of the T-shaped connector 130, and at the other end of the horizontal frames 120*a* and 120*b*, fixing holes 121*a* and 121*b* are formed into which the protrusion 151 of the straight line-shaped connector 150 is inserted.

In order for the fixing protrusion 151 of the straight line-shaped connector 150 to be elastically protrusive, an elastic member 152 is installed inside the left and right half portions to thereby elastically support the fixing protrusion 151.

A compressive coil spring may be used as the elastic member 152, but, in terms of easy assembling, it is preferred to use a torsion spring consisting of a fixing support unit 152*a* supported by the inner circumferential surface of the left and right half portions and an elastic support unit 152*b* supporting the fixing protrusion 151.

In order to prevent an arbitrary separation between the fixing protrusion 151 and the elastic support portion 152*b*, preferably, a fixing groove 151*a* is formed at the bottom of the fixing protrusion 151 and an insertion-fixing portion 152*c* is formed bent at the elastic support portion 151*b* so as to be insertedly fixed at the fixing groove 151*a*.

The assembly structure of the fixing protrusion 151 and the elastic member 152 are the same as that of the above-mentioned fixing protrusion 134 and the elastic member 135 as shown in FIG. 7.

The pool body 200 is formed by junctioning a sheet fabricated from a synthetic resin. The pool body 200 is formed in a polygonal box shape when it is unfolded, including a base unit 210 and a circumferential side wall 220 upwardly extended from the marginal portion of the base unit 210.

The base unit 210, making the bottom side of the set-up space of the pool, is formed in a polygonal figure corresponding to the plane figure formed by the vertical frames 110 and the horizontal frames 120.

A plurality of pocket units 221 are formed at the upper portion of the circumferential side wall 220, into which the plurality of horizontal frames 120 are respectively inserted.

An open portion 222 is formed between the mutually adjacent pocket units 221, where the T-shaped connector is positioned.

In terms of a fine view, the open portion 222 is preferably formed in a size to expose only the connection unit 133 of the T-shaped connector 130.

Between the marginal portion of the base unit 210 and the lower end of circumferential side wall 220, a plurality of support pieces 230 having an insertion hole 231, into which the lower end of the vertical frame 110 is inserted, are junctioned at the position corresponding to the lower end of each vertical frame 110, extending horizontally.

Assembling the prefabricated swimming pool constructed as described above in accordance with the first embodiment of the present invention is as follows.

In a state that the support cap 140 is combined with the lower end of the vertical frame 110, the horizontal frame 120 is inserted into the pocket unit 221 formed at the upper end of the circumferential side wall 220 of the pool body 200 so that the both ends of the horizontal frame 120 are exposed. And then, the both-sided horizontal unit 132 of the T-shaped connector 130 is inserted into both ends of the adjacent horizontal frame 120 for connection, and the vertical portion 131 of the connector 130 is insertedly combined with the upper end of the vertical frame 110.

At this time, when the both-sided horizontal unit 132 of the T-shaped connector 130 is inserted into the both ends of the horizontal frame 120, the fixing protrusion 134 elastically protruded at the horizontal unit 132 is pressed by the inner circumferential surface of the horizontal frame 120 and pushed into the horizontal unit 132 against the elastic member 135, and when the fixing protrusion 134 is positioned at the fixing hole 121 of the horizontal frame 120, it is protruded by the elasticity of the elastic member so as to be inserted into the fixing hole 121.

In this respect, the vertical frame 110 and the T-shaped connector 130 may be inserted by the slide-fitting into the upper end of the vertical frame 110. Or, in the fabricating process, the vertical portion 131 may be forcibly combined with the upper end of the vertical frame 110, so that the vertical frame 110 and the T-shaped connector 130 can be kept or dealt with as a single assembly part.

After assembling all the horizontal frames 120 and the vertical frames 110 in the above manner except one horizontal frame 120, since the circumferential side wall 220 of the pool body 200 supported by the vertical frames 110 and the horizontal frames 120 is tightly stretched, making it difficult to widen the space between the first horizontal frame and the n-1th horizontal frame, and thus, the horizontal frame 120 is not able to be connected therebetween.

Accordingly, for this part, as shown in FIG. 4, the horizontal frames 120*a* and 120*b* as divided in the middle portion are inserted into the pocket unit 221 formed at the upper end of the circumferential side wall 220 of the pool body 200, so that the outer ends of the divided horizontal frames 120*a* and 120*b* are connected with the adjacent horizontal frames 120 and the T-shaped connectors 130 and the inner ends of the divided horizontal frames 120*a* and 120*b* are connected by the straight line-shaped connector 150, thereby completing assembling of them.

In detail, the outer end (left end) of the left side divided horizontal frame 120*a* is connected with the first horizontal frame by means of the T-shaped connector 130, and the left half portion of the straight line-shaped connector 150 is inserted into the inner end (left end) of the divided horizontal frame 120*a*. In this state, when the outer end (right end) of the right side divided horizontal frame 120*b* is connected with the n-1th horizontal frame 120 by means of the T-shaped connector 130, as shown in FIG. 5, the inner end (left end) of the right side divided horizontal frame 120*b* is not overlapped with the end of the right half portion of the straight line-shaped connector 150 as inserted in the left side divided horizontal frame 120*a*. In this state, as shown in FIG. 6, the right half portion of the straight line-shaped connector 150 is drawn out from the left side divided horizontal frame 120*a* and inserted into the right side divided horizontal frame 120*b*, and the fixing protrusions 151 elastically protruded at the left and right half portions of the straight line-shaped connector 150 are inserted into the fixing holes 121*a* and 121*b* formed at the left and right side divided horizontal frames 120*a* and 120*b*.

In this respect, the left and right divided horizontal frames 120*a* and 120*b* are connected by means of the straight line-shaped connector 150, each inner end of the left and right side divided horizontal frames 120*a* and 120*b* are not attached to each other, maintaining a certain distance.

The processes of inserting the fixing protrusions 151 into the fixing holes 121*a* and 121*b* are the same as those of inserting the fixing protrusion 134 of the T-shaped connector 130 into the fixing hole 121 as described above, descriptions of which are thus omitted.

After the pool frame 100 and the pool body 200 are completely assembled as described above, the pool body 200 is filled with water, thereby using as a handy swimming pool.

At this time, since the circumferential side wall 220 of the pool body 200 is supported by the vertical frames 110 and the horizontal frames 120, even if a user leans or is bumped against the circumferential side wall, the circumferential side wall 220 won't incline or collapse, and thus, it can be used stably and safely.

Figure 8:
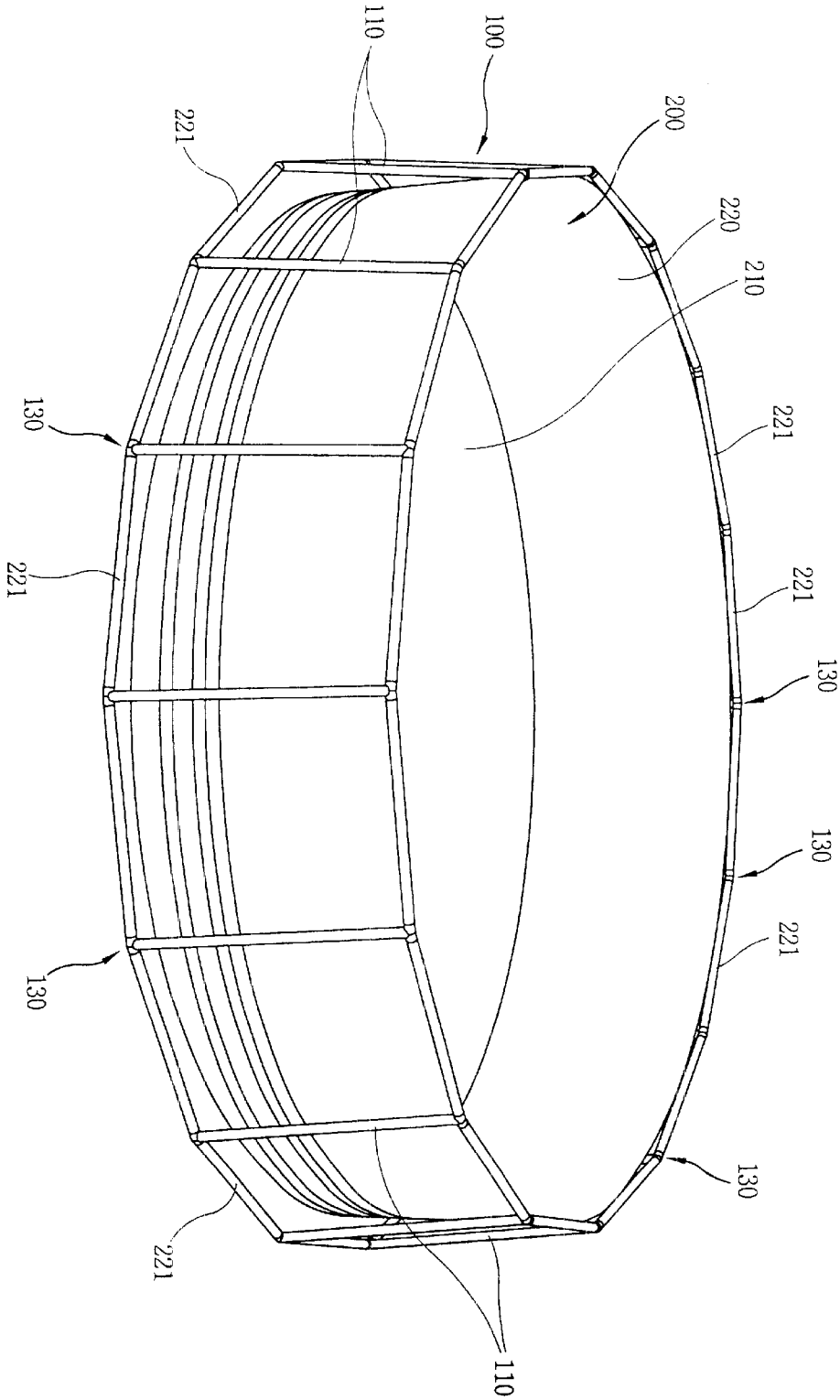
Figure 9:
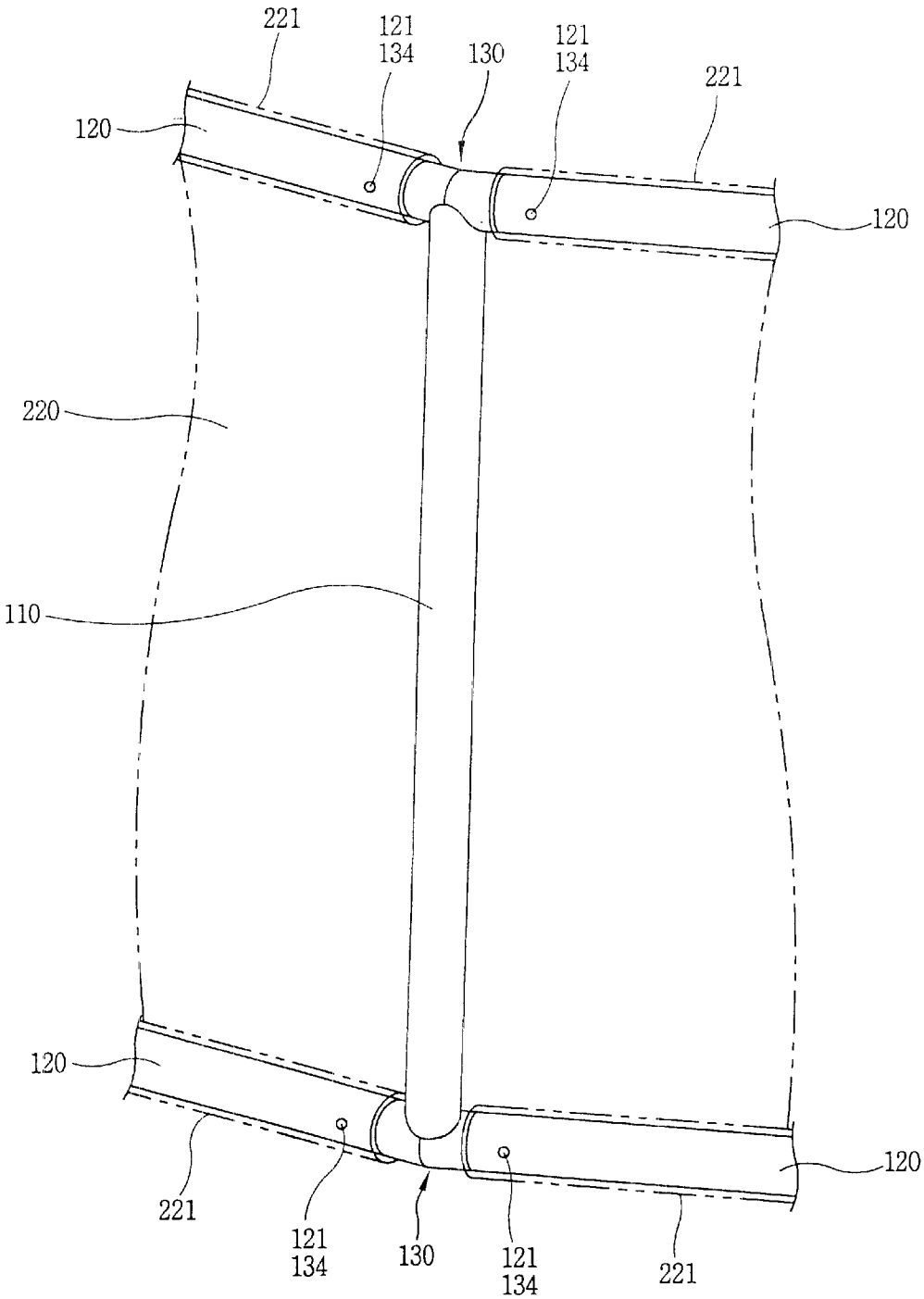
Figure 10:
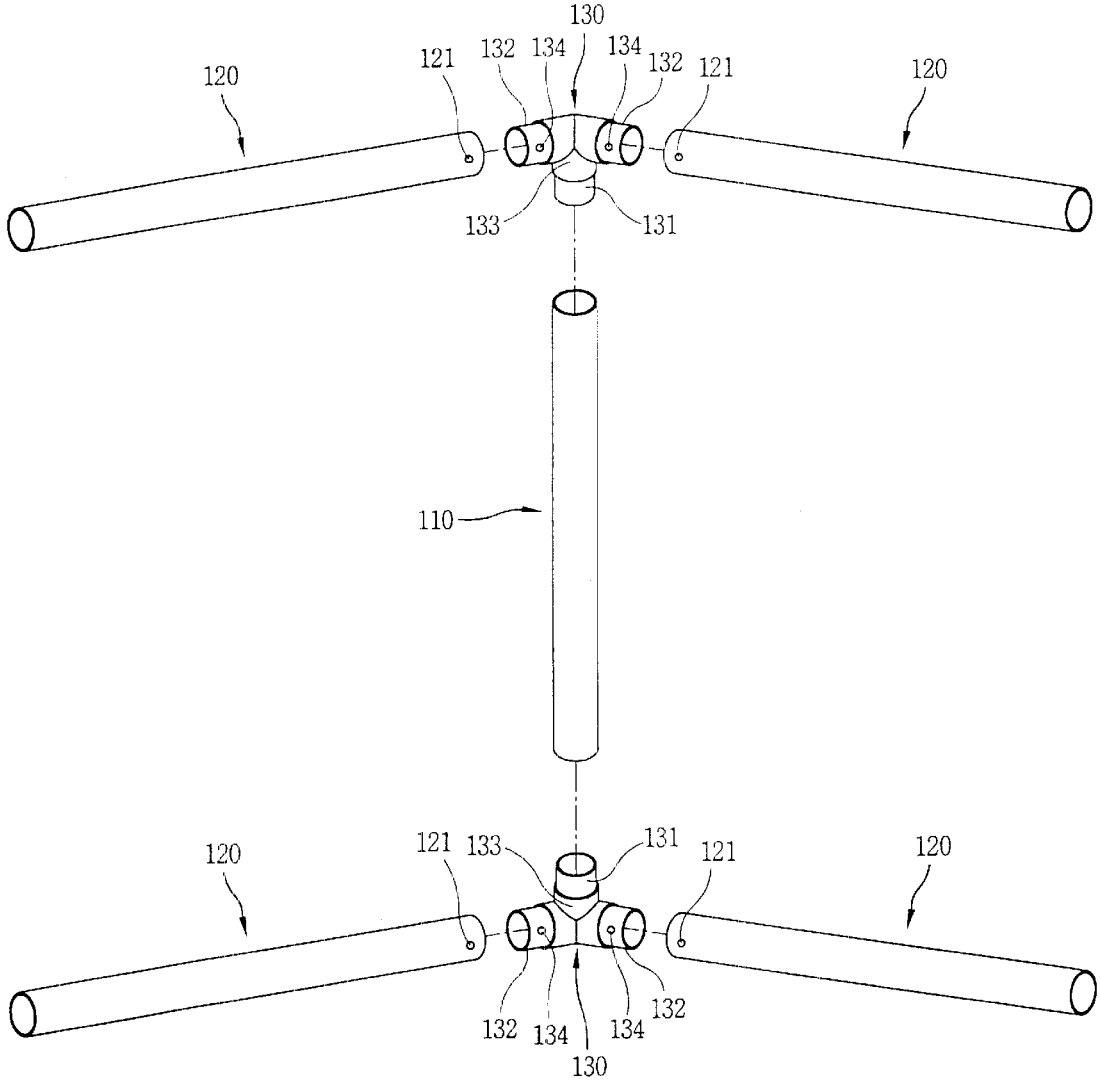

FIGS. 8 through 10 illustrate a prefabricated swimming pool in accordance with a second embodiment of the present invention, in which the lower horizontal frames 120 with the same structure as the upper horizontal frames 120 connected at the upper end portion of the vertical frame 110 are connected at the lower end portion of the vertical frame 110 by means of the upper and lower T-shaped connectors 130, and pocket units 221 are formed at the upper and lower edges of the circumferential side wall 220 into which the upper and lower horizontal frames are respectively inserted, so the vertical frames 110 are supported by the upper and lower horizontal frames 120 on the base surface.

An open portion 222 is formed between the mutually adjacent pocket units 221, where the T-shaped connectors 130 are positioned.

As shown in FIG. 9, the open portions 222 expose the connection units 133 of the T-shaped connectors 130. (See FIG. 3)

Figure 11:
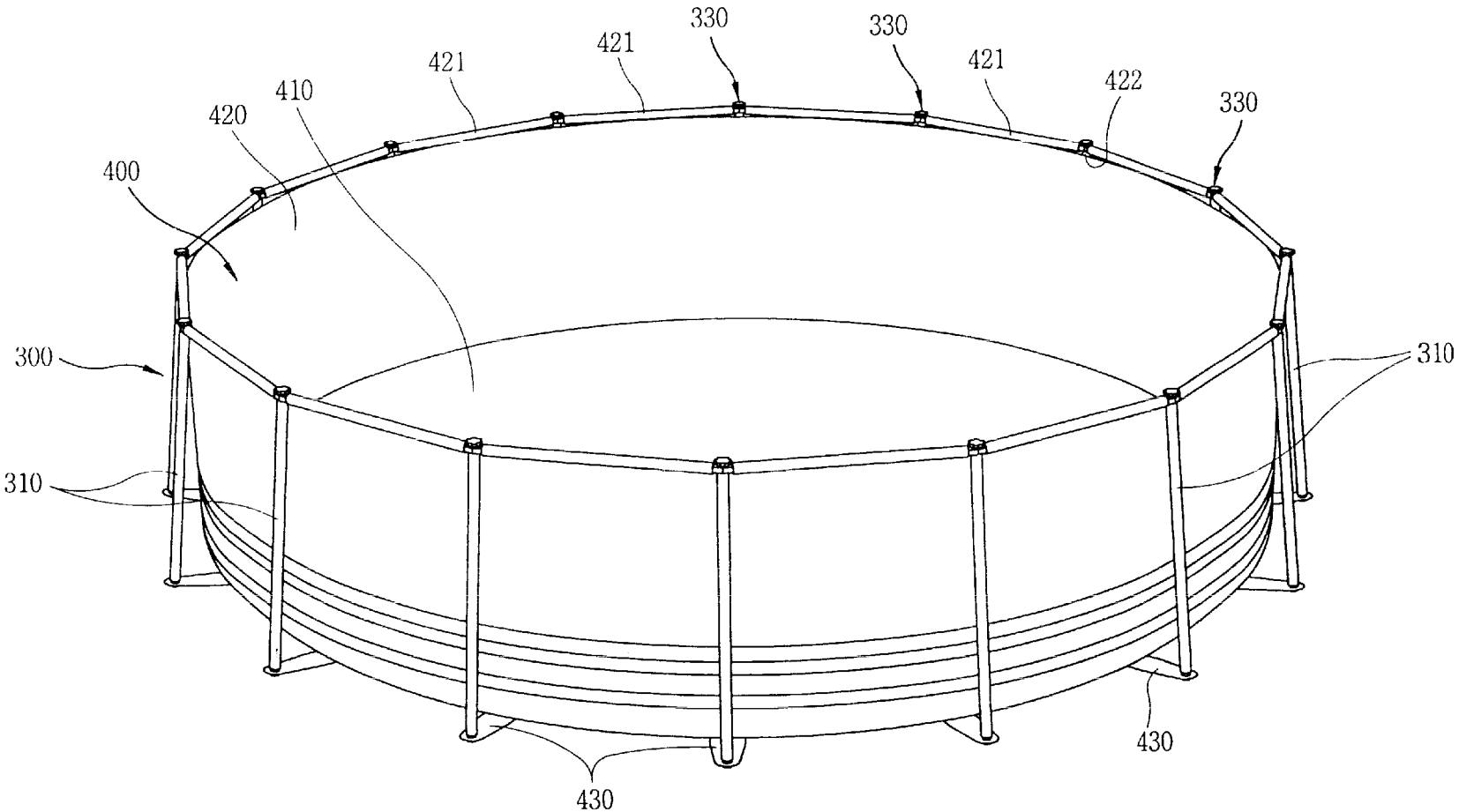
Figure 12:
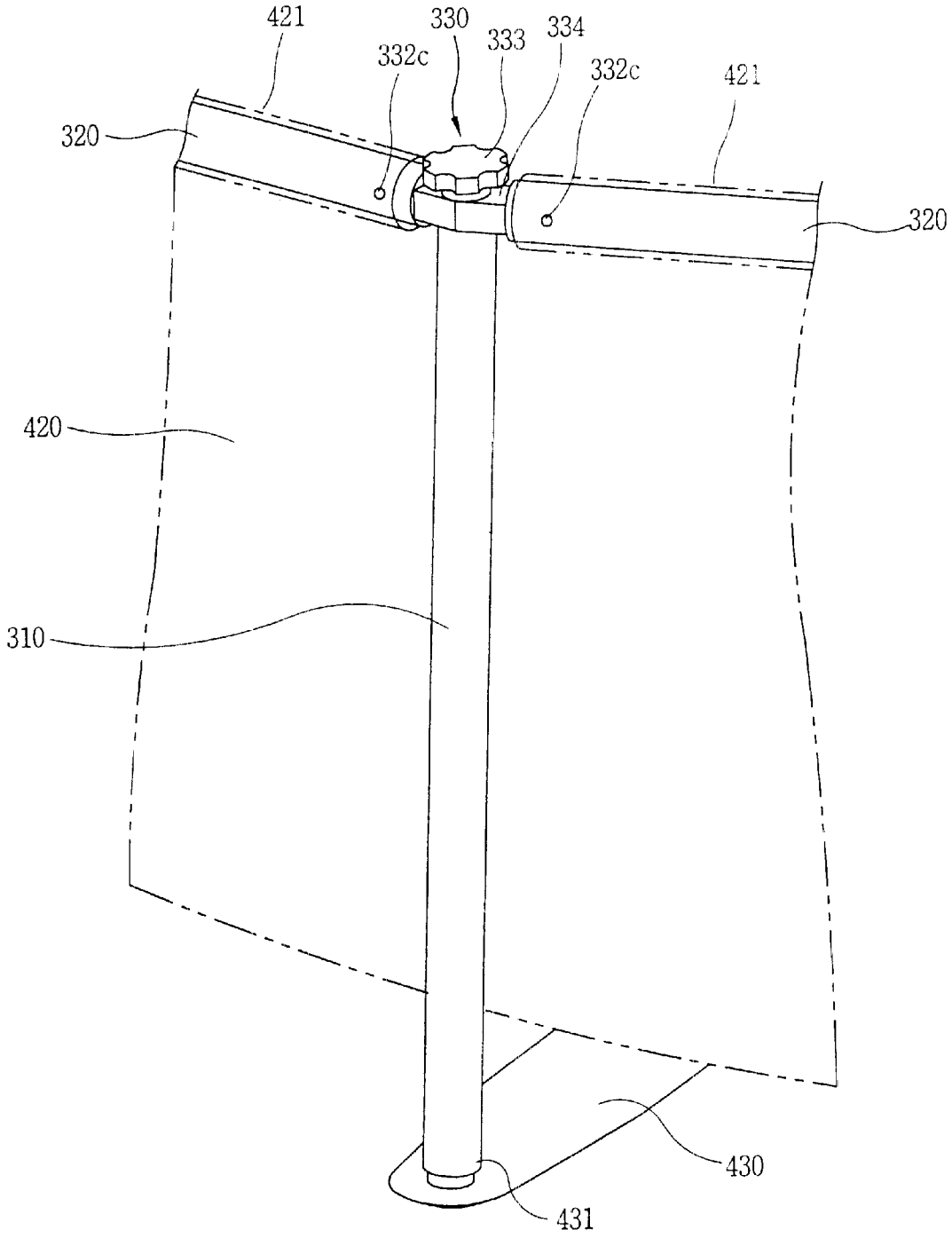
Figure 13:
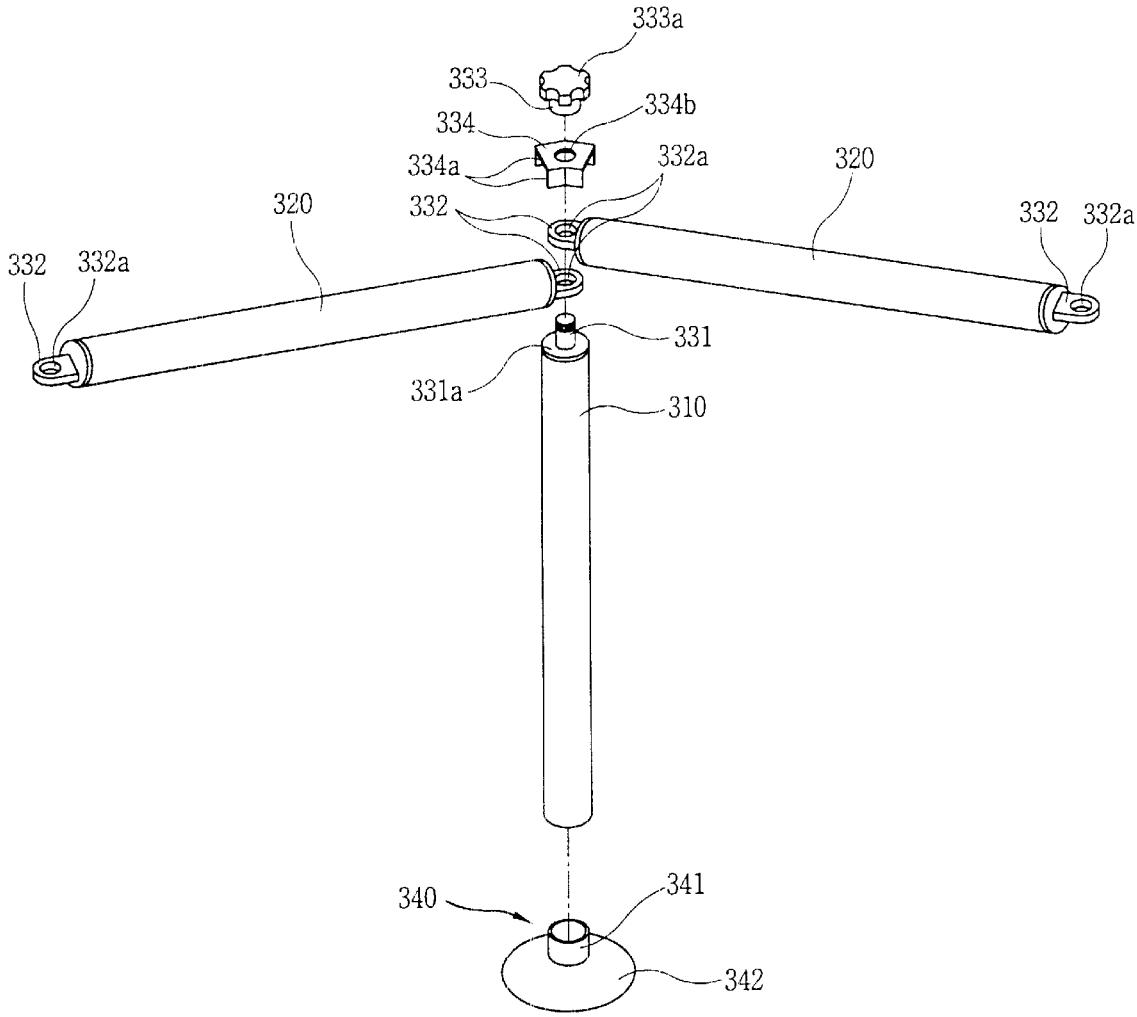

FIGS. 11 through 13 illustrate a prefabricated swimming pool in accordance with a third embodiment of the present invention, of which FIG. 11 is a perspective view of the prefabricated swimming pool, FIG. 12 is partial enlarged view of a pool frame and a pool body; and FIG. 13 is an enlarged disassembled perspective view of the pool frame.

In the drawings, reference numeral 300 denotes a pool frame, and 400 denotes a pool body supported by the pool frame 300.

The pool frame 300 includes a plurality of vertical frames 310 and a plurality of horizontal frame 400 connecting the upper ends of the vertical frames 310.

The vertical frame 310 and the horizontal frame 320 are formed of a hollow and circular pipe, which is, nonetheless, not limited thereto.

The upper end of the vertical frame 310 and the both-sided horizontal frame 320 to be connected to the upper ends of the vertical frame 310 are connected by a thread-engaging type connector 330.

The connector 330 includes a bolt bar 331 protruded at the upper end portion of the vertical frame 310, connection pieces 332 protruded from the end portion of the horizontal frame 320, being overlapped up and down, and having a through hole 332*a* into which the bolt bar 331 is penetrated, and a nut 333 engaged with the protruded the bolt bar 331 through the through hole 332*a* of the connection piece 332.

The bolt bar 331 is integrally formed with a fixing bar 331*a* that is forcibly and insertedly fixed at the upper end of the vertical frame 310.

The connection pieces 332 are integrally formed with fixing bars 332*a* that is inserted into both ends of the horizontal frame 320 and fixed with pins 332*b*.

The connection pieces 332 are disposed upside and downside on the basis of the central horizontal plane of the horizontal frame 320. They are fabricated the same as each other in fabrication, and when they are assembled, the mutually adjacent horizontal frames 320 are turned 180° for use.

For users' convenience, in order to manually tighten or release without using a tool, preferably, the nut 333 is integrally formed with a handle portion 333*a*.

As mentioned above, the angle between the horizontal frames 320 is determined depending on the number of the horizontal frames. If the connection pieces 332 are engaged with only the bolt bar 331 and the nut 333 for fixing, the both-sided horizontal frame 320 may turn arbitrarily, failing to maintain a determined angle. Thus, in order to prevent the both-sided horizontal frame 320 from turning, an angle maintaining member 334 is coupled to the connection pieces 332, and in this state, the bolt bar 331 is penetrated through the connection pieces 332 and the angle maintaining member 334, and then engaged with the nut 333.

The angle maintaining member 334 is formed in a channel shape with both sides opened into which the connection pieces 332 are inserted. It includes a restriction side 334*a* for restricting the angle of the connection pieces 332 in contacting the marginal portion of the connection pieces 332, and a through hole 334*b* on its upper surface into which the bolt bar 331 is penetrated.

A support cap 340 supported on the base surface is combined with the lower end of the vertical frame 310.

The support cap 340 includes an insertion part 341 insertedly fixed with the lower end portion of the vertical frame 310 and a protrusion part 342 formed protruded outwardly.

The support cap 340 may be formed with inside filled. Preferably, in order to reduce the weight, the support cap 340 is formed with inside empty except for the bottom surface thereof.

The insertion part 341 may be insertedly fixed to the lower end portion of the vertical frame 310 by force, or may be inserted in a manner of slide fitting and fixedly combined thereto by inserting a fixing pin penetrating the lower end portion of the circumferential wall side of the vertical frame 130 and the circumferential wall side of the insertion part 341.

The pool body 400 is formed by junctioning a sheet fabricated from a synthetic resin. The pool body 200 is formed in a polygonal box shape when it is unfolded, including a base unit 410 and a circumferential side wall 420 upwardly extended from the marginal portion of the base unit 410.

The base unit 410, making the bottom side of the set-up space of the pool, is formed in a polygonal figure corresponding to the plane figure formed by the vertical frames 310 and the horizontal frames 320.

A plurality of pocket units 421 are formed at the upper portion of the circumferential side wall 420, into which the plurality of horizontal frames 320 are respectively inserted.

An open portion 422 is formed between the mutually adjacent pocket units 221, where the T-shaped connector is positioned.

In terms of a fine view, the open portion 422 is preferably formed in a size to expose only the angle maintaining member 334 of the connector 330.

Between the marginal portion of the base unit 410 and the lower end of circumferential side wall 420, a plurality of support pieces 430 having an insertion hole 431, into which the lower end of the vertical frame 310 is inserted, are junctioned at the position corresponding to the lower end of each vertical frame 310, extending horizontally.

The prefabricated swimming pool constructed as described above in accordance with the first embodiment of the present invention is assembled as follows.

First, the support cap 340 combined with the lower end portion of the vertical frame 310 of the pool frame 300 is inserted into the insertion hole 431 of the support piece 430 formed between the marginal portion of the base unit 410 and the lower end of the circumferential side wall 420 so that the lower end portion of the pool body 400 is supported by the vertical frames 310 of the pool frame 300.

And, the horizontal frames 320 are inserted into the pocket unit 421 formed at the upper end of the circumferential side wall 420 of the pool body 400 with both ends of the horizontal frames exposed. In this state, the connection pieces 332 protruded from both ends of the adjacent horizontal frames 320 are overlapped up and down, on which the angle maintaining member 334 is covered so that the inner side of the restriction side 334*a* is attached with the both circumferential portions of the connection pieces 332.

And then, the support cap 340 combined with the lower end is inserted into the insertion hole 431 of the support piece 430 formed between the marginal portion of the base unit 410 of the pool body 400 and the lower end of the circumferential side wall 420, and in this state, the bolt bar 331 protruded at the upper end of the vertical frame 310 is penetrated through the through holes 332*a* of the connection pieces 332 and the through hole 334*b* of the angle maintaining member 334, so as to be engaged with the nut 333, thereby connecting the vertical frames 310 and the horizontal frames.

In this respect, as for the adjacent horizontal frames 320, since its marginal portions are attached to the restriction side 334*a* of the angle maintaining member 334, the angle therebetween are firmly maintained.

By repeating the connection processes of the vertical frames 310 and the horizontal frames 320, the pool frame 300 is completely assembled, and as the pool body 400 is being supported by the pool frame 300, assembling is completed.

Figure 14:
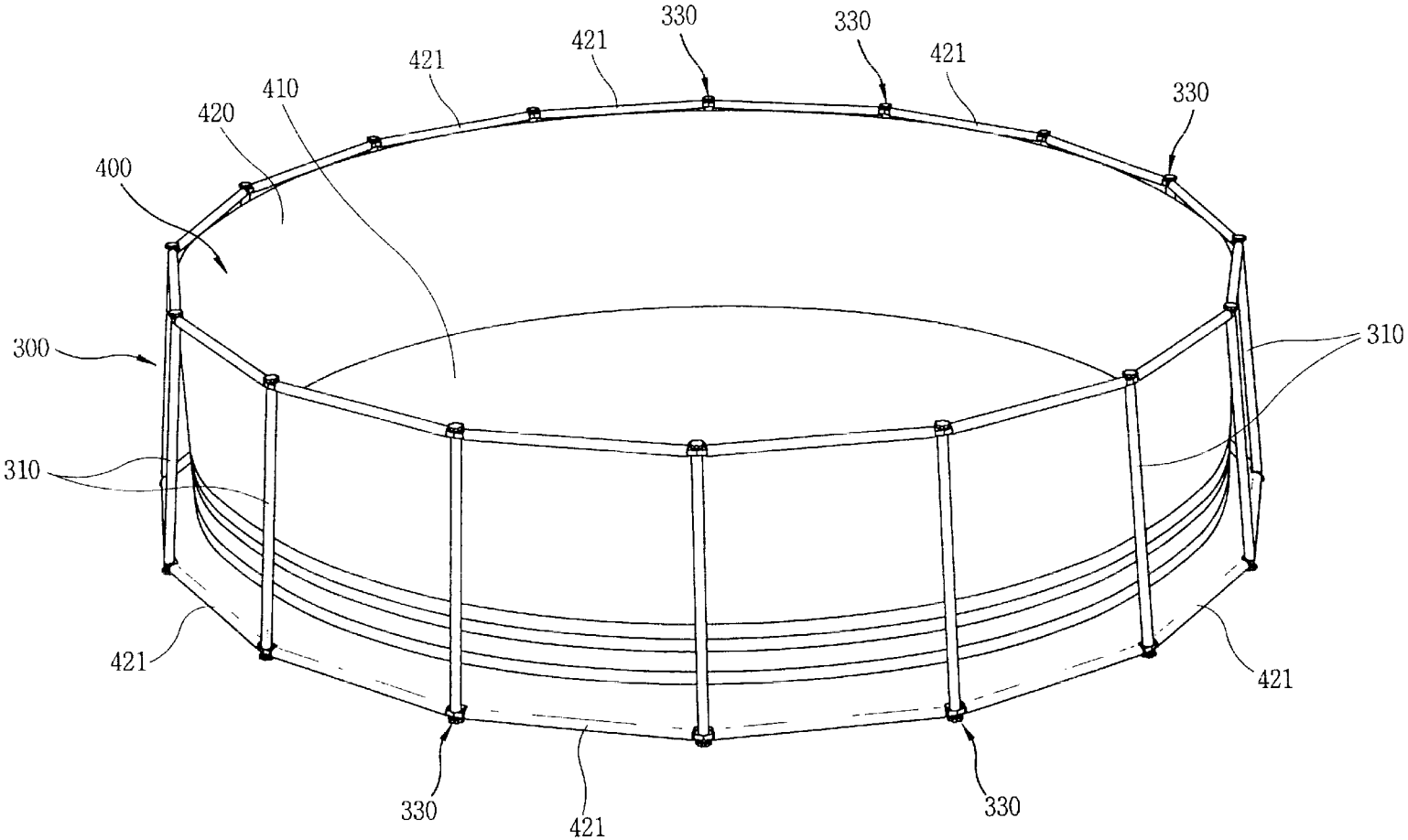
Figure 15:
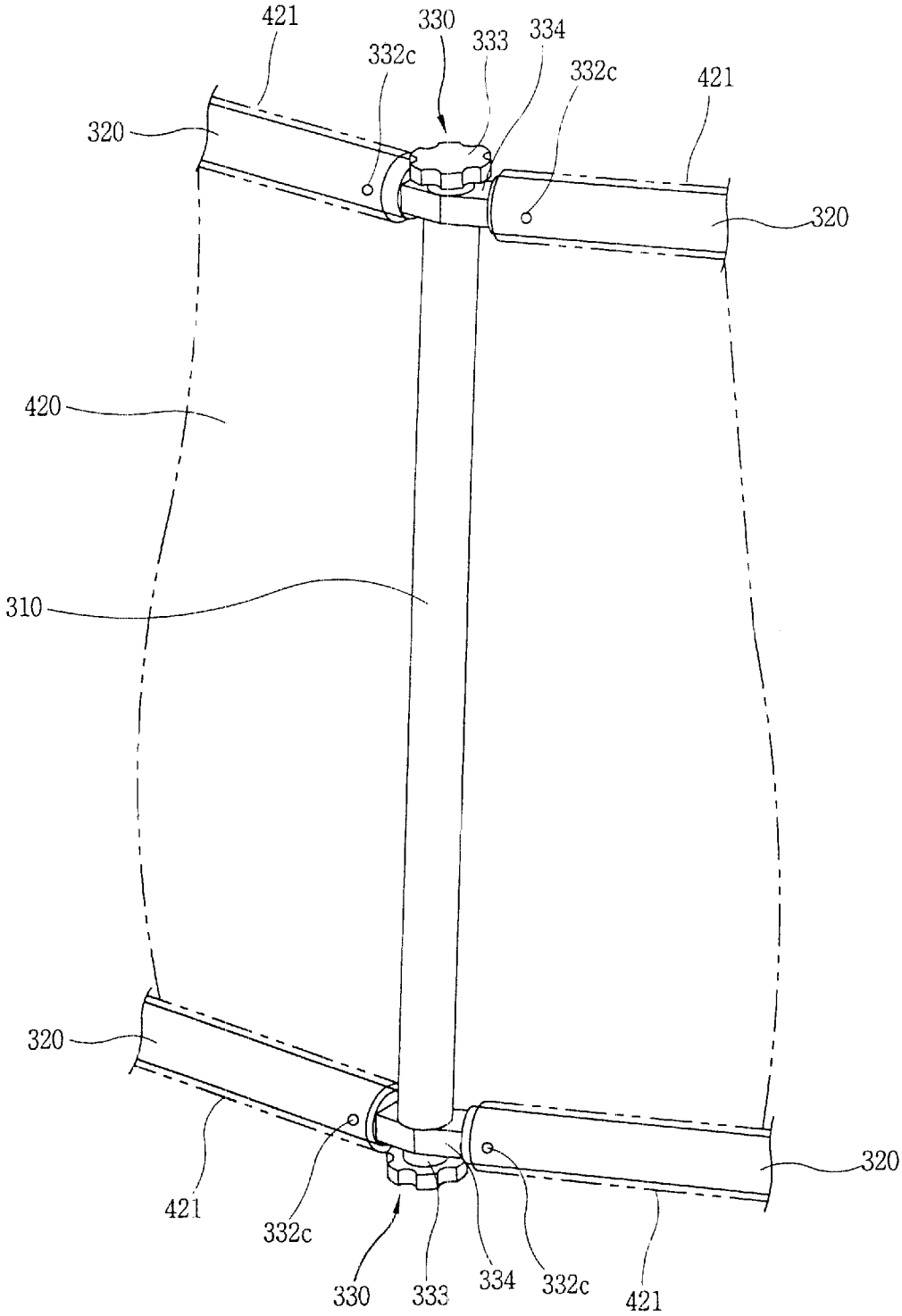
Figure 16:
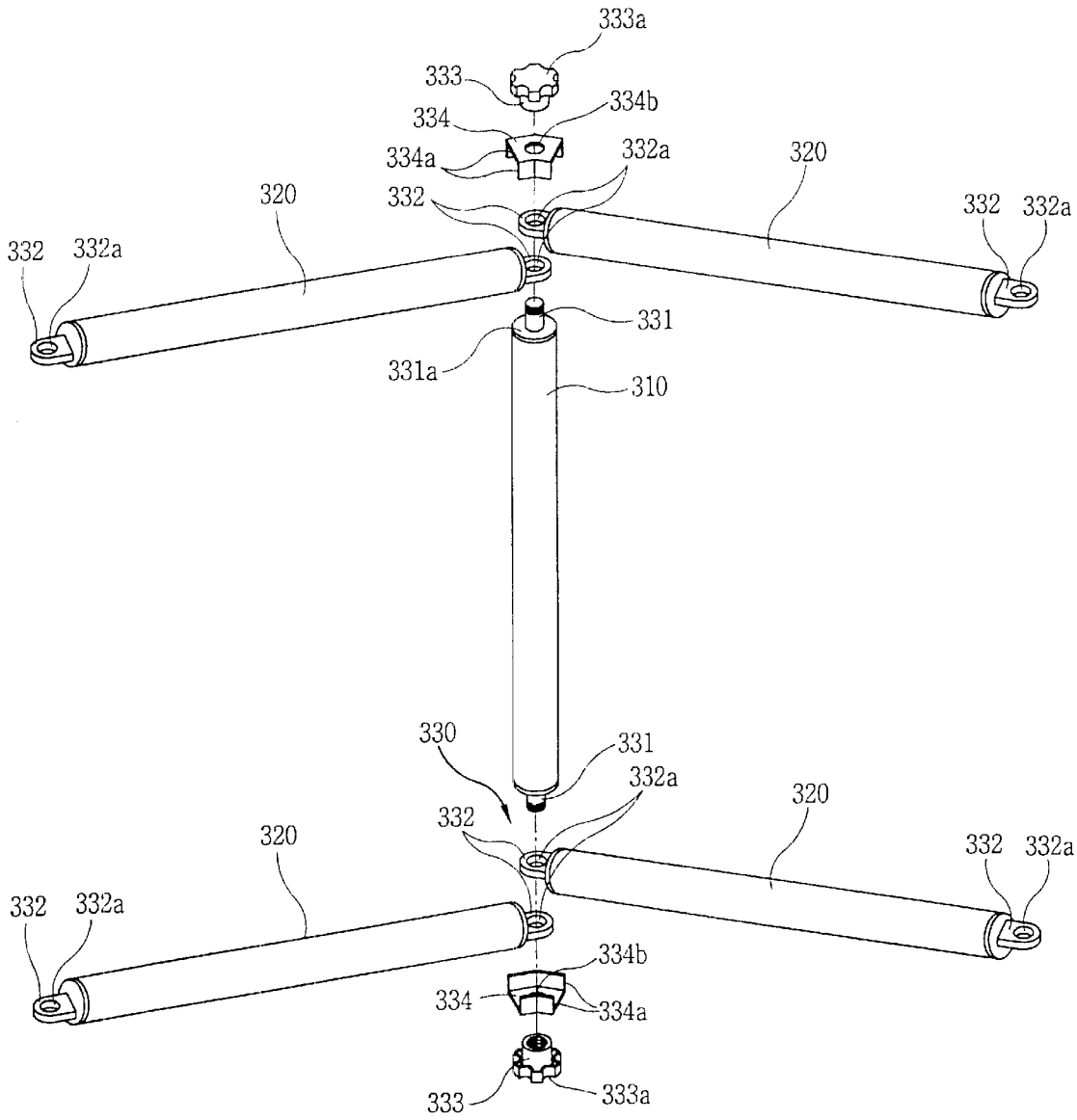

FIGS. 14 through 16 illustrate a prefabricated swimming pool in accordance with a fourth embodiment of the present invention, in which the lower horizontal frames 320 with the same structure as the upper horizontal frames 320 connected at the upper end portion of the vertical frame 310 are connected at the lower end portion of the vertical frame 310 by means of the connectors 330, and pocket units 421 are provided also at the marginal portion between the base unit 210 and the circumferential side wall 420 of the pool body 400, so that the vertical frames 310 are supported by the lower horizontal frames 320 on the base surface. Other constructions are the same as those of the above first embodiment, for which the same reference numerals are given with descriptions omitted.

Figure 17:
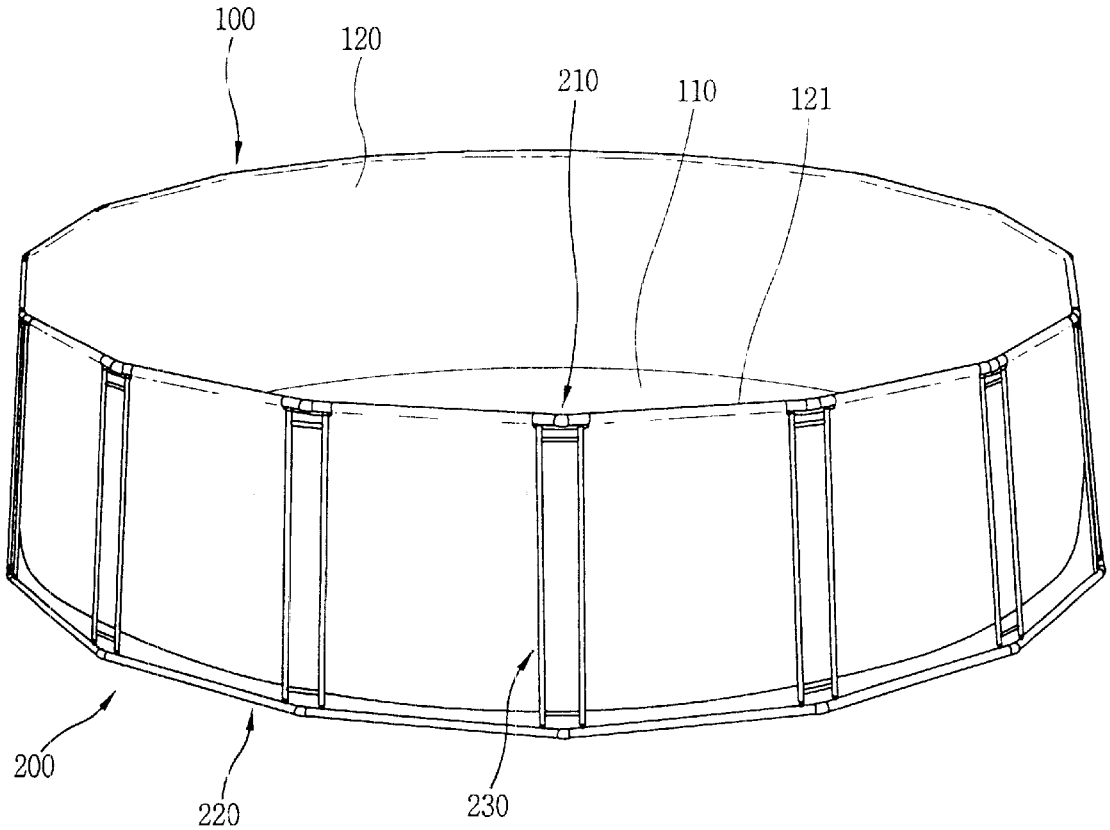
Figure 18:
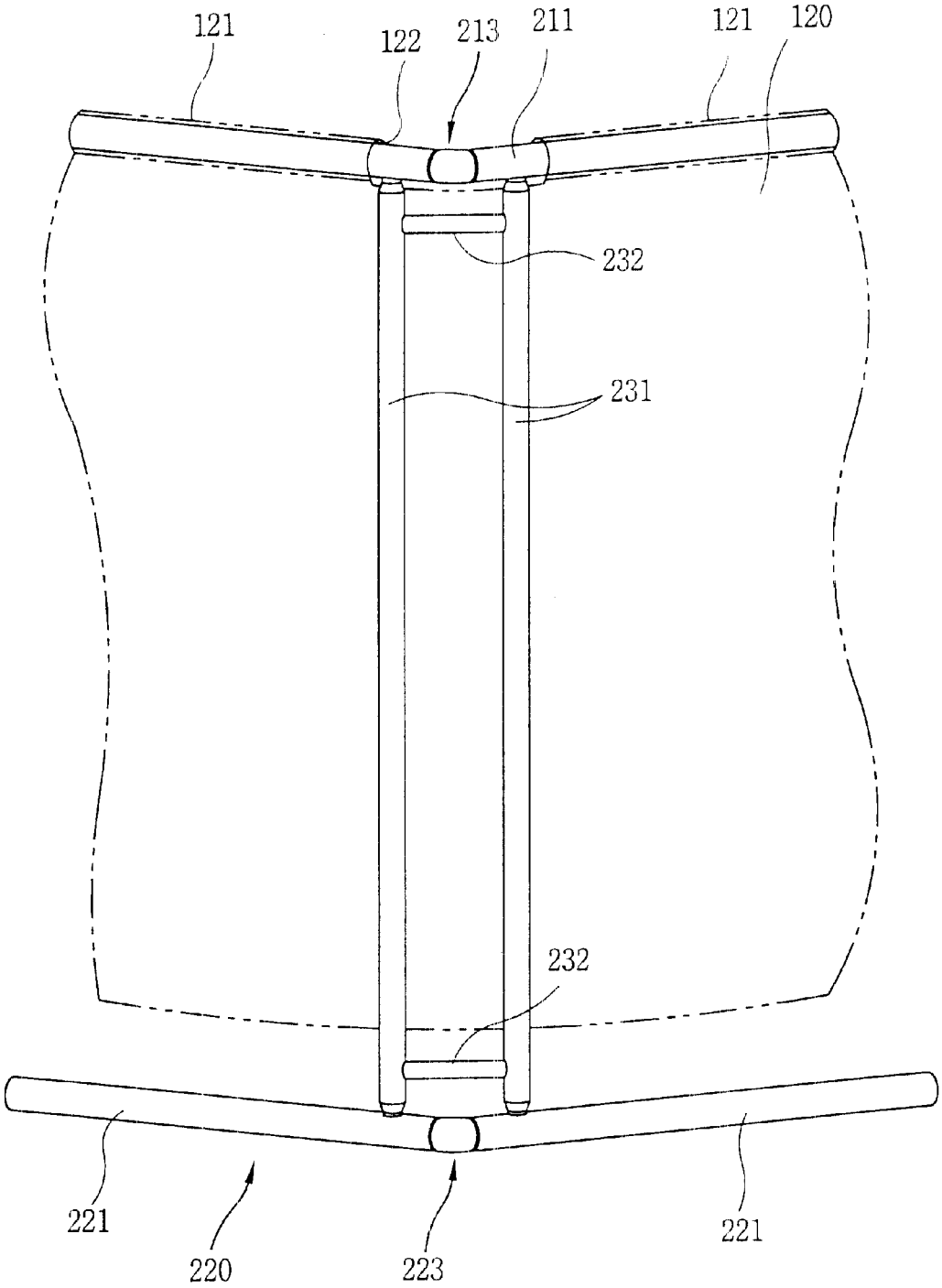
Figure 19:
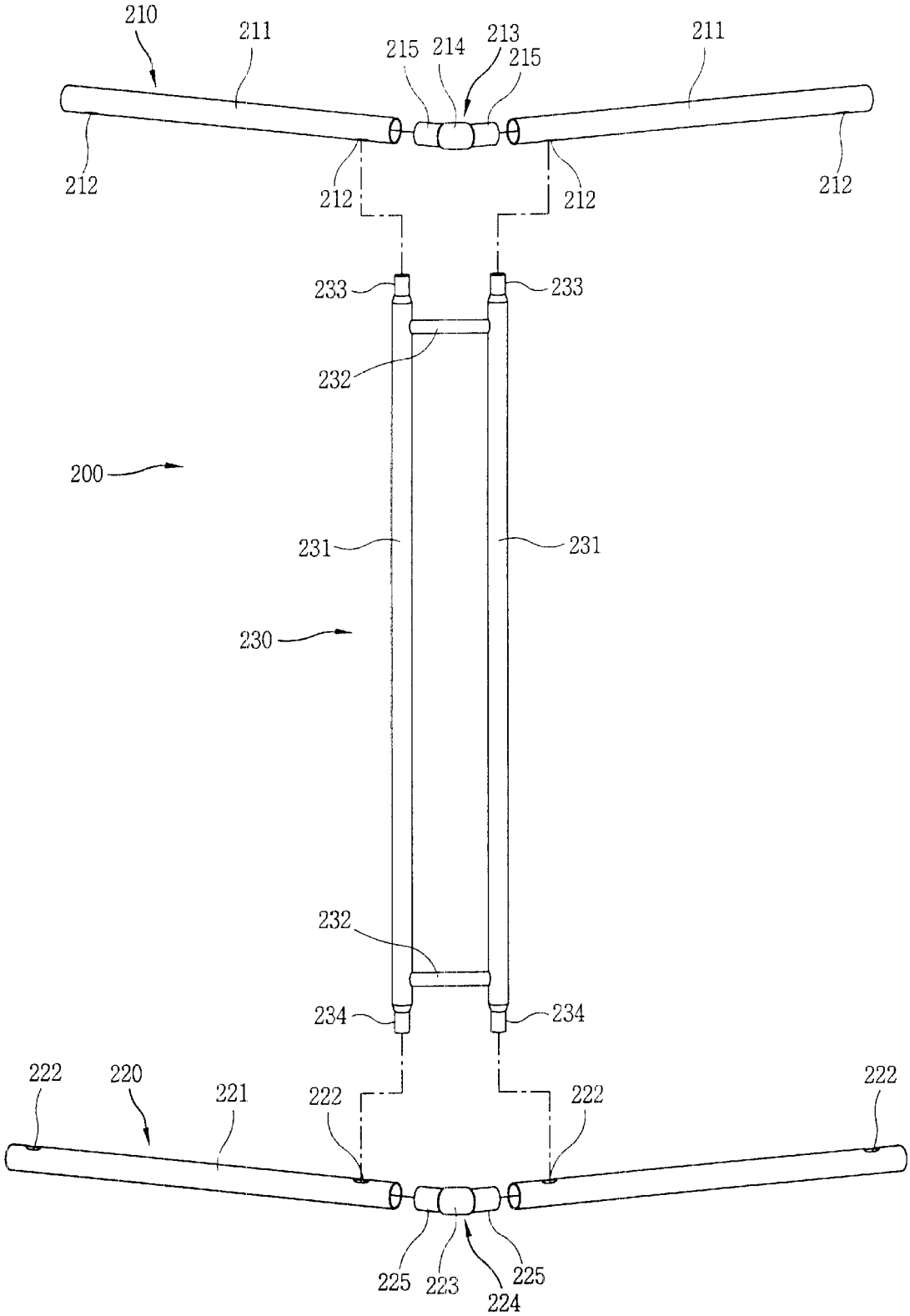
Figure 20:
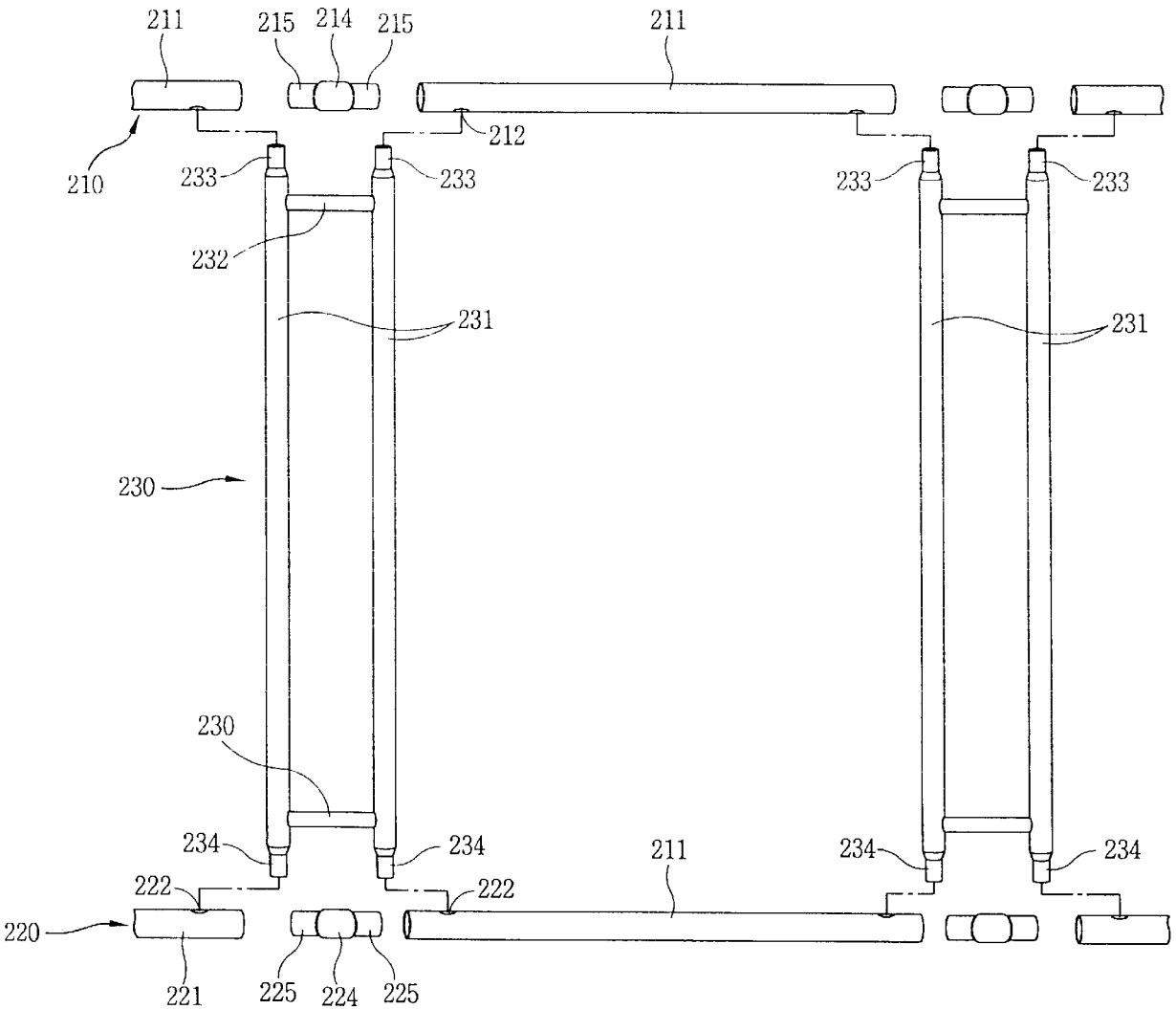
Figure 21:
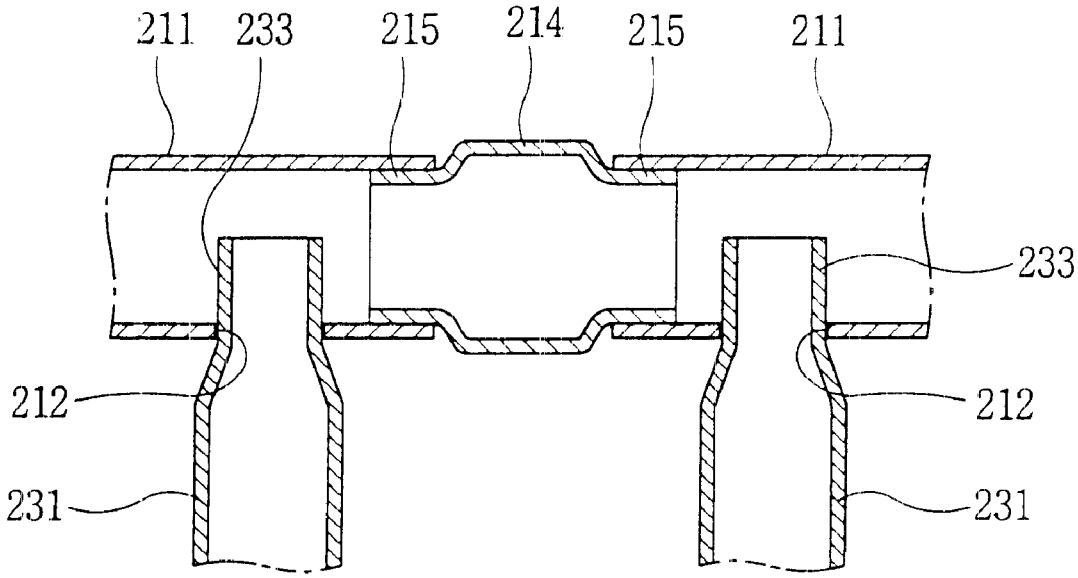

FIGS. 17 through 21 illustrate a prefabricated swimming pool in accordance with a fifth embodiment of the present invention, of which FIG. 17 is a perspective view of an overall assembly; FIG. 18 is a partial enlarged perspective view of FIG. 17; FIG. 19 is a partial disassembled perspective view of a pool frame; FIG. 20 is a partial disassembled exploded view of the pool frame; and FIG. 21 is a partial enlarged sectional view showing a coupling structure of an upper horizontal frame and a vertical frame.

As shown in the drawings, reference numeral 100 denotes a pool body which is to be filled with water, and 200 denotes a pool frame supporting the pool body 100.

The pool body 100 includes a base unit 110 and a circumferential side wall 120 upwardly extended from the margin of the base unit 110.

The pool body 100 is fabricated from a synthetic resin sheet having a water-proof quality and a flexibility with such a thickness that can withstand the pressure of water filled therein.

The base unit 110 is adhered on the ground where the prefabricated swimming pool of the present invention is installed, limiting the area of the swimming pool. In the present invention, the base unit is formed in a polygonal shape or in a circular shape.

A plurality of pockets 121 are formed at the upper end portion of the circumferential side wall 120, and an opening portion 122 is formed between the adjacent pockets 121.

A drain tube (not shown) and a drain valve (not shown) may be installed at the lower end portion of the circumferential side wall 120 to drain the water filled in the swimming pool.

As shown in FIG. 19, the pool frame 200 includes an upper horizontal frame 210 inserted into the pocket 121 to maintain the contour of the upper end portion of the pool body 100, a lower horizontal frame 220 placed on the ground in the facing manner to the upper horizontal frame, and a plurality of vertical frames 230 connecting the upper horizontal frame 210 and the lower horizontal frame 220 and supporting the pool body 100 on the ground.

The upper horizontal frame 210 includes a plurality of horizontal bars 211 inserted into each pocket 121, and an upper horizontal connector 213 for connecting the adjacent upper horizontal bars 211.

And, the lower horizontal frame 220 includes a plurality of lower horizontal bars 221 corresponding to the upper horizontal bars 211 of the upper horizontal frame 210, and a lower horizontal connector 223 for connecting the adjacent lower horizontal bars 221.

The upper and lower horizontal bars 211 and 221 are fabricated of a pipe with a circular section.

At both ends portion of the upper and lower horizontal bars 211 and 221, combining holes 212 and 222 are respectively formed to connect the vertical frame 230.

The upper and lower horizontal connectors 213 and 223 includes an upper and lower horizontal connector body parts 214 and 224 having the same outer diameter as that of the upper and lower horizontal bars 211 and 221, and insertion-connection parts 215 and 225 formed at both ends of the body parts 214 and 224 and having an outer diameter suitable to be inserted into the upper and lower horizontal bars 211 and 221.

It is preferred that the upper and lower horizontal connectors 213 and 223 are fabricated of a pipe with the same sectional shape as that of the upper and lower horizontal bars 211 and 221.

It is preferred that the insertion-connection parts 215 and 225 of the upper and lower horizontal connectors 213 and 223 have such a diameter, smaller than that of the both ends of the horizontal connector body parts 214 and 224, that can be inserted into the upper and lower horizontal bars 211 and 221 by a medium force between a slide fitting and a tight fitting, so that insertion and separation of the insertion-connection parts 215 and 225 into and from the upper and lower horizontal bars 211 and 221 are easily made.

The insertion-connection parts 215 and 225 of the upper and lower horizontal connectors 213 and 223 may be fabricated in a manner that a pipe having a smaller outer diameter than the inner diameter of the horizontal connector body parts 214 and 224 is inserted into the upper and lower horizontal connector body parts 214 and 224 and welded.

The angle between the insertion-connection parts 215 and 225 is to be made the same as the corner angle of the polygon depending on the number of the upper and lower-horizontal bars 211 and 221. For this purpose, it is preferred that the upper and lower horizontal connector body parts 214 and 224 are formed bent at the same angle as the corner angle of the polygon according to the number of the upper and lower horizontal bars 211 and 221.

The lower horizontal bar 221 of the lower horizontal frame 220 is formed longer than the upper horizontal bar 211 of the upper horizontal frame 210, so that when the upper and lower horizontal bars 211 and 221 are connected by the vertical frames 230, the vertical frame 230 can be widened at the lower side, thereby stably maintaining the pool frame 220 in standfast.

The vertical frame 230 includes a pair of vertical bars 231 vertically disposed at the exterior of the circumferential side wall 120 of the pool body 100, a pair of upper and lower connection bars 232 for connecting the pair of vertical bars 231 in a manner that they are maintained at a certain distance in the horizontal direction, and combining portions 233 and 234 respectively formed at the upper and lower end portion of each vertical bar 231 to be inserted into the upper and lower combining holes 212 and 222 formed at the upper and lower horizontal bars 211 and 221.

The vertical bar 231 is made of a pipe having a smaller inner and outer diameter than those of the upper and lower horizontal bars 211 and 221, and the combining portions 233 and 234 is made of a pipe having the same outer diameter as the inner diameter of the vertical bar 231.

The combining portions 233 and 234 are formed by a process of shortening the diameter of the upper and lower end portion of the vertical bar 231.

Or, the combining portions 233 and 234 may be formed by inserting and welding a bit smaller pipe or bar than the inner diameter of the vertical bar 231.

The pair of upper and lower connection bars 232 is made of a pipe having a smaller outer diameter than that of the vertical bar 231. After the connection bars 232 penetratingly inserted into the circumferential wall side of the vertical bar 231, they are welded, so that the pair of vertical bars 231 are maintained in parallel at a certain distance.

As for the prefabricated swimming pool constructed as described above, when it is not intended to use, the pool body 100 is simply folded, and the pool frame 200 is disassembled by separating the upper and lower horizontal bars 211 and 221, the upper and lower horizontal connectors 213 and 223 and the vertical frame 230, by which its overall volume is minimized with a minimum space required for storing and carrying.

In order to meet a desire to use, the pool body 100 and the pool frame 200 are assembled as follows.

The lower horizontal bars 221 are connected by the lower horizontal connectors 223 to thereby form the lower horizontal frame 220 and place it on the ground. And, the base unit 110 of the pool body 100 is unfolded inside the lower horizontal frame 220. In this state, the upper horizontal bars 211 are inserted into each pocket 121 and the adjacent upper horizontal bars 211 are connected by means of the upper horizontal connectors 213 to thereby assemble the upper horizontal frame 210. Thereafter, the upper and lower combining portions 233 and 234 of the vertical bar 231 constructing the vertical frame 230 are inserted into the upper and lower combining holes 212 and 222 formed at the upper and lower horizontal bars 211 and 221. Then, the circumferential side wall 120 of the pool body 100 is stood, forming the figure of the pool body 100.

In this state, when water is put in the pool body 100, the base unit 110 of the pool body 100 is adhered onto the ground due to the water pressure, becoming flat, while the circumferential side wall 120 is inflated outwardly, maintaining a tight state, which is suitable to use as a swimming pool.

At this time, the water pressure applied to the circumferential side wall 120 is transferred through the upper horizontal frame 210 to the vertical frame 230. In this respect, since the lower horizontal bar 221 constructing the lower horizontal frame 220 is longer than the upper horizontal bar 211 constructing the upper horizontal frame 210, making that the area occupied by the lower horizontal frame 220 is larger than the area occupied by the upper horizontal frame 210, and the vertical frames 230 are installed to be widened outwardly at its lower side, even though the pool body is loaded as being filled with water, there is no possibility that the pool body is inclined outwardly or collapses, compared to a pool body of which vertical frames are formed stood completely vertical. Thus, the pool body can be stably maintained.

After finishing using the prefabricated swimming pool in accordance with the embodiment of the present invention, when it is desired to be disassembled for storing or carrying, a drain valve (not shown) installed at the circumferential side wall 120 of the pool body 100 is opened to drain the water through a drain tube (not shown), and then the swimming pool is disassembled in the reverse order of the assembling.

Figure 22:
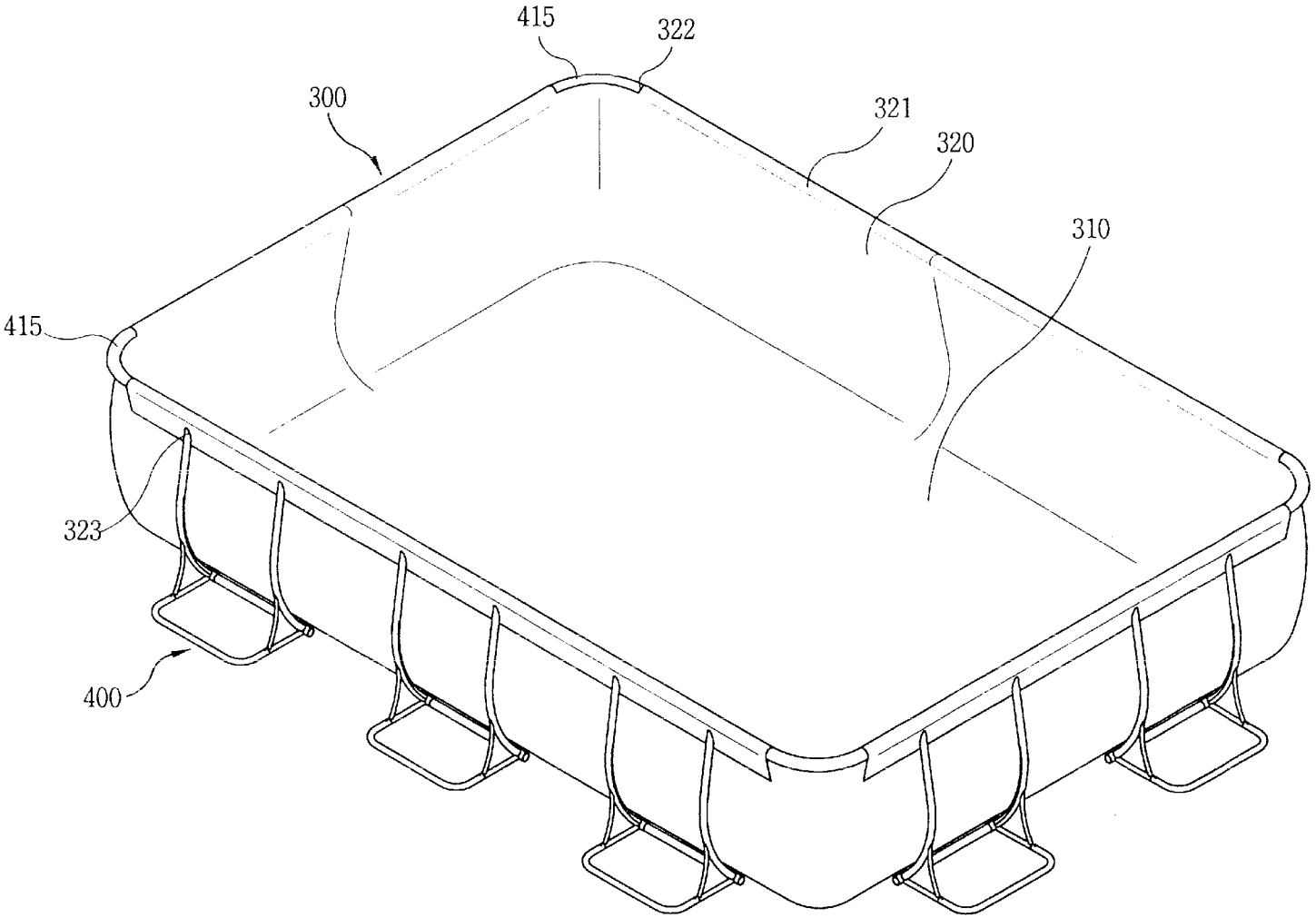
Figure 23:
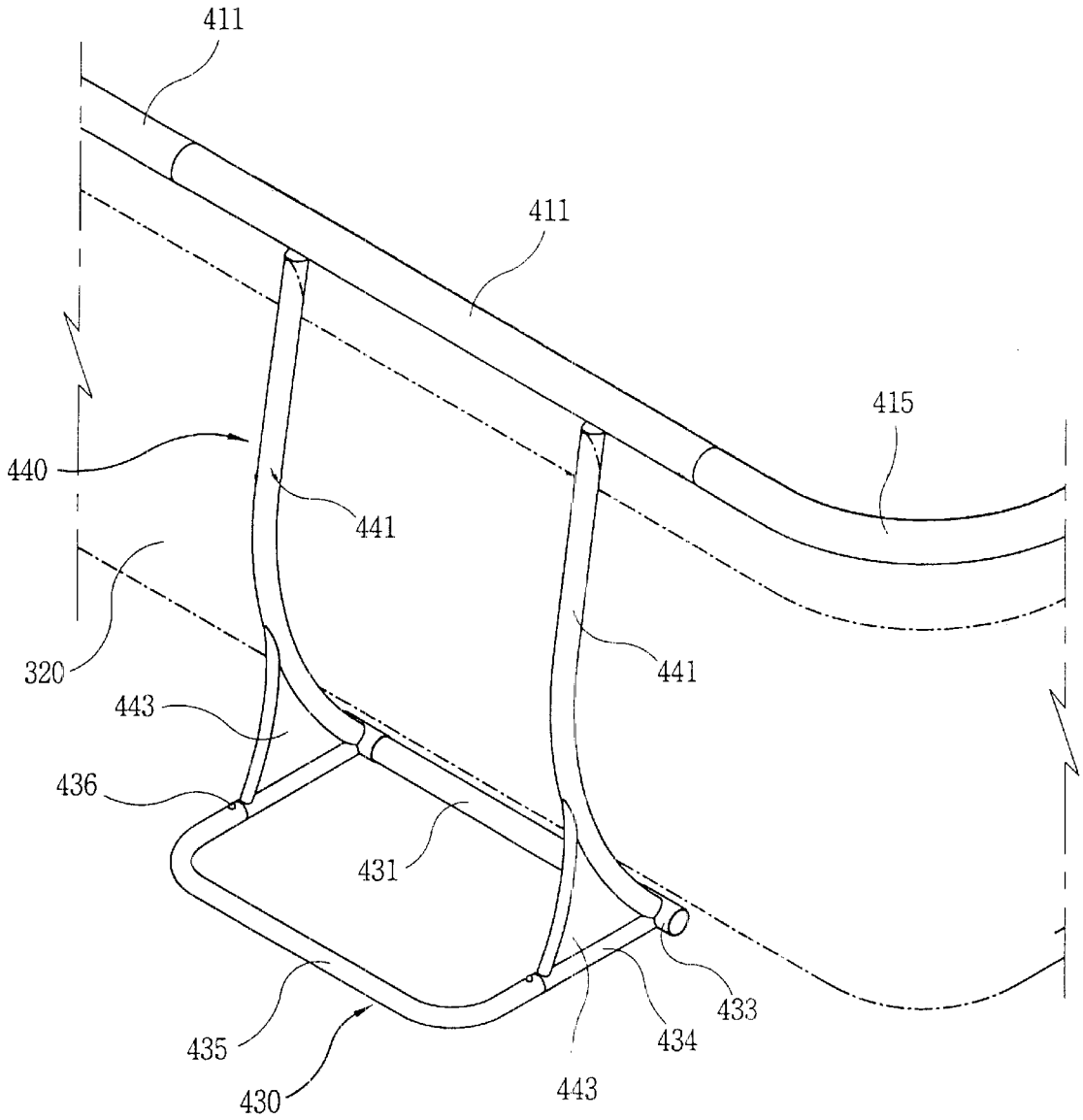
Figure 24:
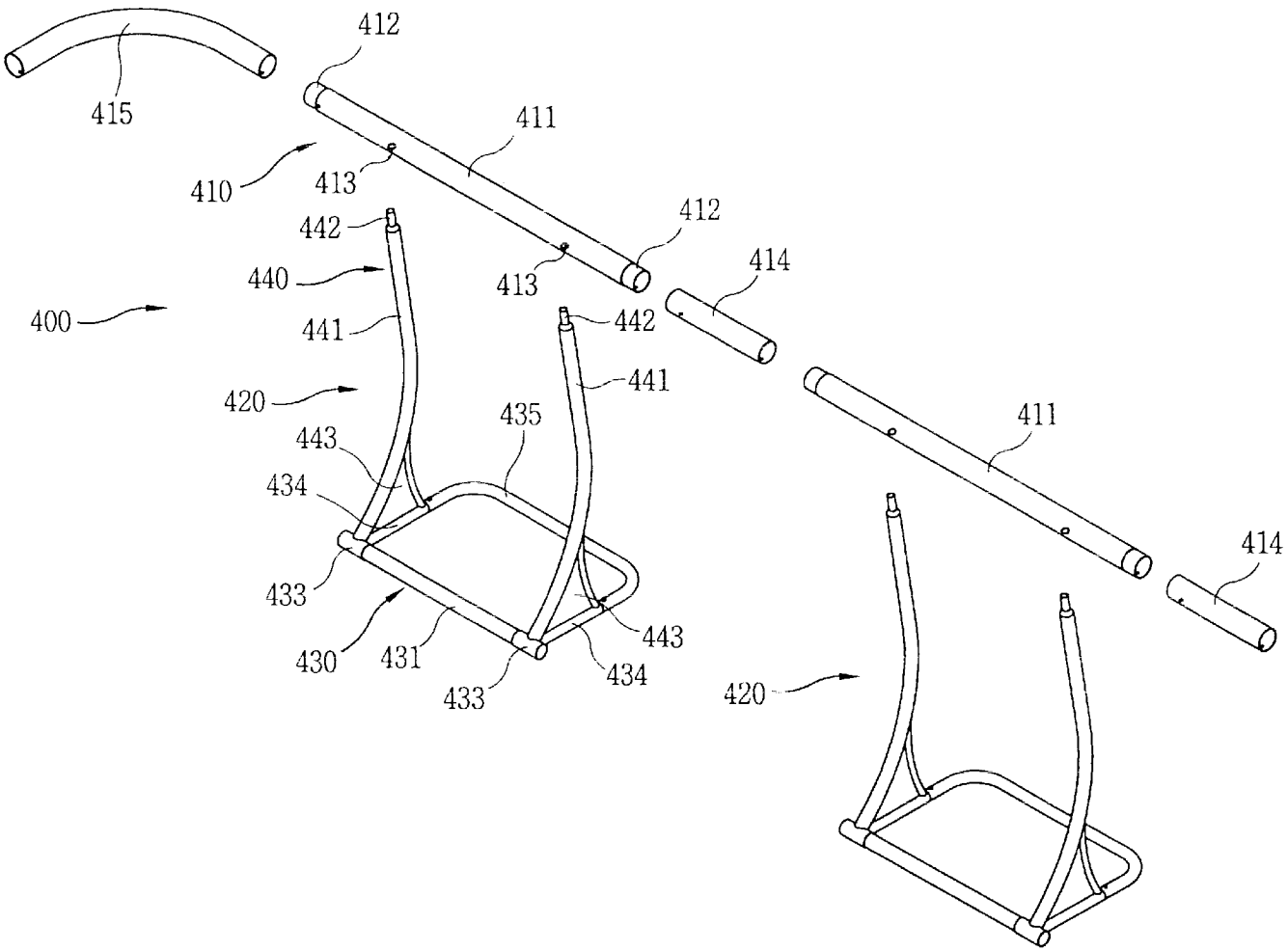
Figure 25:
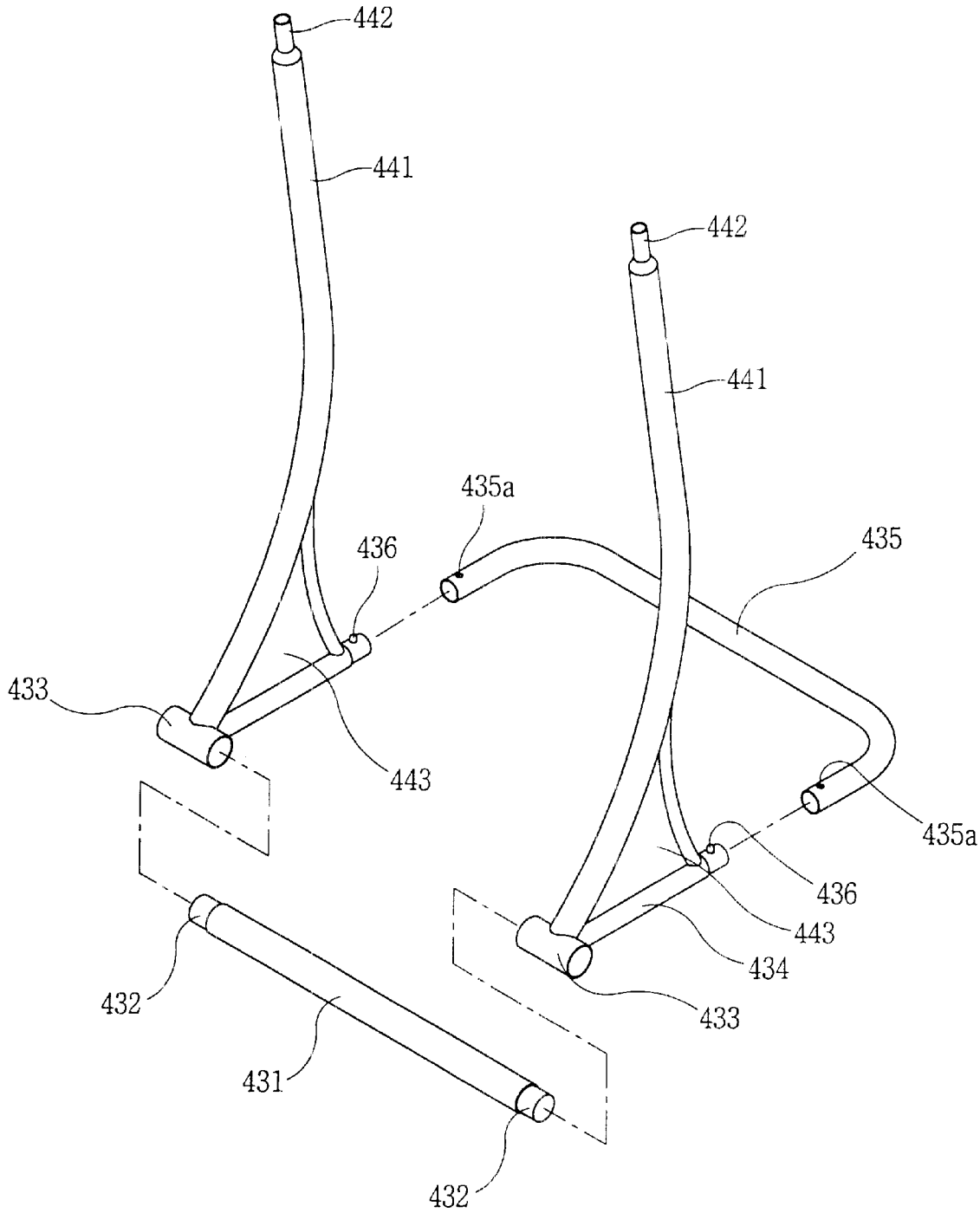
Figure 26:
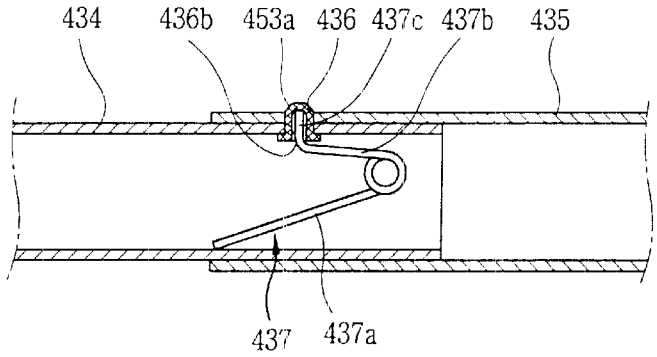

FIGS. 22 through 26 illustrate a prefabricated swimming pool in accordance with a sixth embodiment of the present invention, of which FIG. 22 is a perspective view of an overall assembly; FIG. 23 is a partial enlarged perspective view of FIG. 22; FIG. 24 is a partial disassembled perspective view of a pool frame; FIG. 25 is a disassembled perspective view of a vertical frame; and FIG. 26 is a partial enlarged sectional view showing an assembled state of a support unit of the vertical frame.

In the drawings, reference numeral 300 denotes a pool body, and 400 denotes a pool frame for supporting the pool body 300.

The pool body 300 includes a base unit 310, and a circumferential side wall 320 upwardly extended from the marginal portion of the base unit 310.

A material for the pool body 300 is the same as that of the fifth embodiment.

The base unit 310 is adhered onto the ground where the prefabricated swimming pool in accordance with the present invention, limiting the area of the swimming pool. In the present invention, the base unit 310 is formed in a rectangular shape.

A pocket 321 is formed at the upper end portion of the circumferential side wall 320, and an opening portion 322 is formed at the corner.

Through holes 323 are formed at the pocket 321 into which the upper end of the vertical frame 420 is penetrated.

Likewise in the above stated fifth embodiment of the present invention, a drain tube (not shown) and a drain valve (not shown) may be installed to drain water filled in the swimming pool.

The pool frame 400 includes a horizontal frame 410 inserted into the pocket 321 to maintain a contour of the upper end portion of the pool body 300, and a plurality of vertical frames 420 for supporting the horizontal frame 410.

As shown in FIG. 24, the horizontal frame 410 includes a plurality of horizontal bars 411, linear connection bars for linearly connecting the horizontal bars, and corner connection bars 415 for connecting the horizontal bars 411 at the corner portions.

The horizontal bar 411, the linear connection bar 414 and the corner connection bar 415 are made of a pipe with circular section having the same inner and outer diameter to each other.

A horizontal connection portion 412 is formed at both ends of the horizontal bar 411, so as to be inserted into the linear connection bar 414 and into the corner connection bar 415.

It is preferred that the horizontal connection portion 412 has such a diameter, smaller than that of the both ends of the horizontal bar 411, that can be inserted into the linear connection bar 414 and into the corner connection bar 415 by a medium force between a slide fitting and a tight fitting, so that insertion and separation of the horizontal connection portion 412 into and from the linear connection bar 414 and the corner connection bar 415 are easily made.

The horizontal connection portion 412 may be formed by inserting a pipe having a bit smaller outer diameter than that of the inner diameter of the horizontal bar 411, the linear connection bar 414 and the corner connection bar 415 into the both ends of the horizontal bar 411 and welding it.

In the vicinity of both end portions of the horizontal bar 411, combining holes 413 are formed with which the upper end of the vertical bar 441 (to be described) is insertedly combined.

The vertical frame 420 includes a support unit 430 to be placed on the ground, and a pair of vertical units 440 extended upwardly from the inner end of the support unit 430, of which upper end is combined with the horizontal frame 410.

As shown in FIG. 25, roughly in a square frame type, the support unit 430 may be fabricated by bending and welding a circular pipe in one body. But as shown in the drawing, the support unit 430 preferably includes an inner bar 431, a connection bar 433 detachably combined with the both ends of the inner bar 431, a pair of both-side bars 434 welded to the connection bar 433 and extended outwardly, and an outer bar 435 connecting the outer ends of the both-side bars 434.

At the both ends of the inner bar 431, there are formed connection portions 432 having a smaller diameter than that of the inner bar 431, so as to be inserted into the connection bar 433.

The outer bar 435 is roughly formed in a channel shape, so that the inner ends thereof are detachably combined with the outer ends of the both-sided bar 434.

In order to detachably combine the inner ends of the outer bar 435 with the outer ends of the both-side bar 434, the both-side bar 434 may have a smaller diameter than that of the inner diameter of the outer bar 435 so that the both-side bar 434 is insertedly combined with the outer bar 435 by a medium force between a slide fitting and a tight fitting.

In this respect, as shown in FIG. 26, it is preferred that the both-side bar 434 has a smaller outer diameter than the inner diameter of the outer bar 435, a fixing hole 435*a* is formed on the circumferential wall of the outer bar 435, and a fixing protrusion 436 is elastically protruded corresponding to the fixing hole 435*a*, so that when the outer end portion of the both-side bar 434 is inserted into the inner end portion of the outer bar 435, the fixing protrusion 436 is elastically pushed down. And then, when the fixing protrusion 436 is positioned at the fixing hole 435*a*, it is elastically protruded to be inserted therein. The both-side bar 434 and the outer bar 435 are separated from each other by being pulled inwardly and outwardly while the fixing protrusion 436 is being pressed down.

In order to render the fixing protrusion 436 to be elastically protruded, an elastic member 437 is installed inside the both-side bar 434, so as to elastically support the fixing protrusion 436.

As the elastic member 437, a compressive coil spring may be used. Yet, as shown in FIG. 26, in order to facilitate assembling, it is preferred to use a torsion spring consisting of a fixing support portion 437*a* supported by the inner circumferential surface of the both-side bar 434 and an elastic support portion 437*b* supporting the fixing protrusion 436.

In order to prevent an arbitrary separation between the fixing protrusion 436 and the elastic support portion 437*b*, preferably, a fixing groove 436*a* is formed at the bottom of the fixing protrusion 436 and an insertion-fixing portion 437*c* is formed bent at the elastic support portion 437*b* so as to be insertedly fixed at the fixing groove 436*a*.

The vertical unit 440 is fixed at both side of the inner end of the support unit 430 and extended upwardly. In the drawing, the vertical unit 440 includes a vertical bar 441 welded at the upper portion of the connection bar 433, extended in a curve outwardly until roughly middle portion thereof and then inwardly extended in a curve to reach the upper end, and a reinforcing plate 443 welded between the outer side of the vertical bar 441 and the upper side of the both-side bar 434.

At the upper end portion of the vertical bar 441, there is formed a combining portion 442 having a shortened diameter to be inserted into the combining hole 413 formed at the horizontal bar 411.

As described above, the prefabricated swimming pool in accordance with the embodiment of the present invention is divided by the pool by 300 that can be folded and the pool frame 400 that can be disassembled by separating the horizontal bar 411, the linear connection bar 414, the corner connection bar 415, the inner bar 431, the outer bar 435, the connection bar 433, the vertical bar 441 and the reinforcing plate 443. By doing that, its overall volume can be minimized, and thus, a small space is required for storing and carrying.

Assembling of the pool body 300 and the pool frame 400 is as follows. The plurality of vertical frames 420 are disposed to stand on the ground, and the pool body 300 is unfolded inside the vertical frames 420. And then, the horizontal frame 410 is assembled in a manner that after the horizontal bars 411 and the linear connection bars 414 are coupled and respectively inserted into the pockets 321 of four sides through the opening portions 322 formed at the corner portions, the horizontal bars 411 inserted in the pockets 321 of each side are connected by the corner connection bars 415. Thereafter, the combining portion 442 formed at the upper end of the vertical bar 441 is inserted into the combining hole 413 formed on the horizontal bar 411 through the through hole 323 formed at the pocket 321, to thereby combine the horizontal frame 410 and the vertical frame 420. Then, the circumferential side wall 320 of the pool body 300 is stood, forming the figure of the pool body 300.

In this state, when water is put in the pool body 300, the base unit 310 of the pool body 300 is adhered onto the ground due to the water pressure, becoming flat, while the circumferential side wall 320 is inflated outwardly, maintaining a tight state, which is suitable to use as a swimming pool.

At this time, the water pressure applied to the circumferential side wall 320 is transferred through the upper horizontal frame 410 to the vertical frame 420. In this respect, since the vertical bar 441 constructing the vertical frame 420 is formed extended from the inner end of the support unit 430 in an outward curve until the middle portion and then extended in an inward curve to reach the upper end thereof, so that there is no possibility that the pool body is inclined outwardly or collapses, compared to a pool body of which vertical frames 440 are formed stood completely vertical. Thusly, a stable state of the pool body can be maintained.

After finishing using the prefabricated swimming pool in accordance with the embodiment of the present invention, when it is desired to be disassembled for storing or carrying, a drain valve (not shown) installed at the circumferential side wall 320 of the pool body 300 is opened to drain the water through a drain tube (not shown), and then the swimming pool is disassembled in the reverse order of the assembling.

Figure 27:
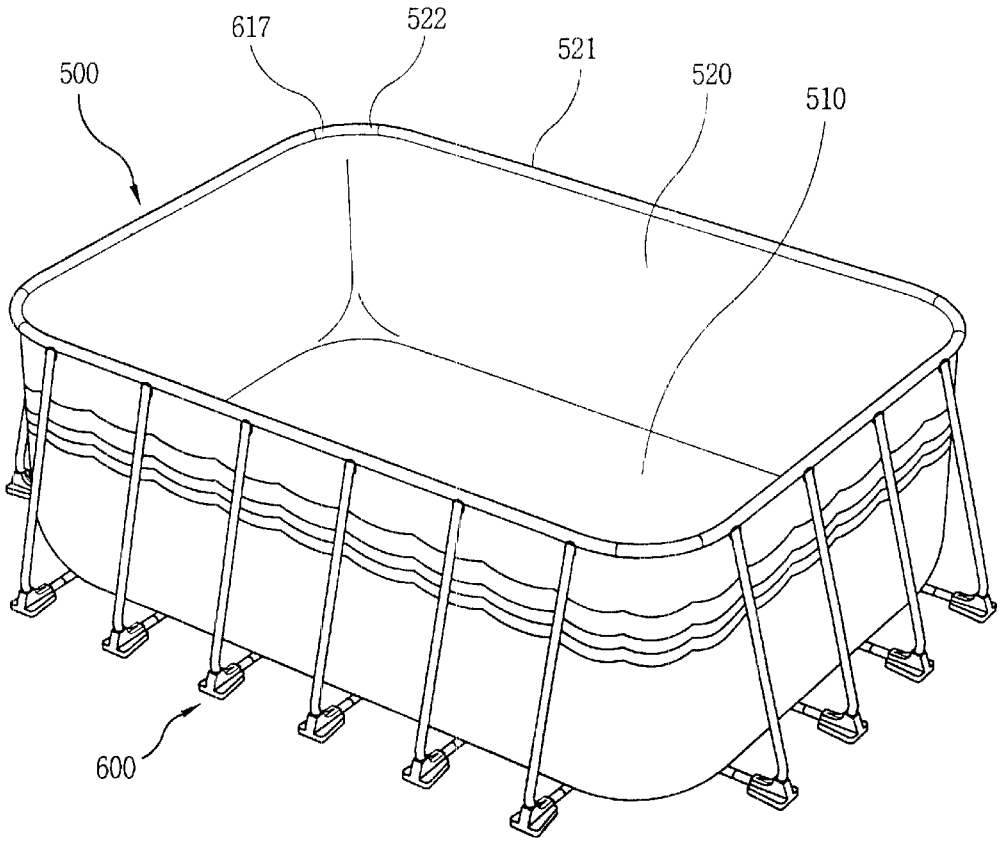
Figure 28:
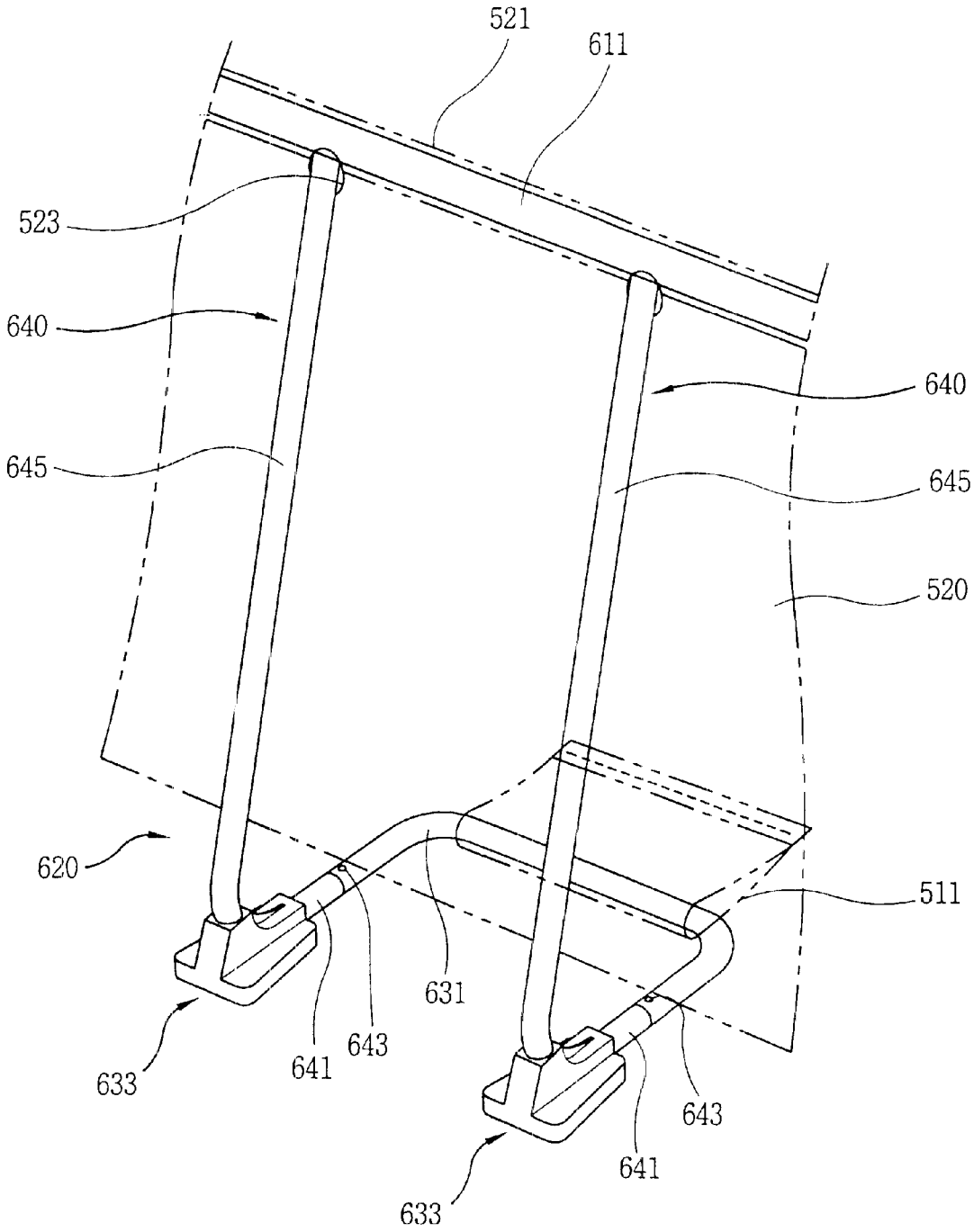
Figure 29:
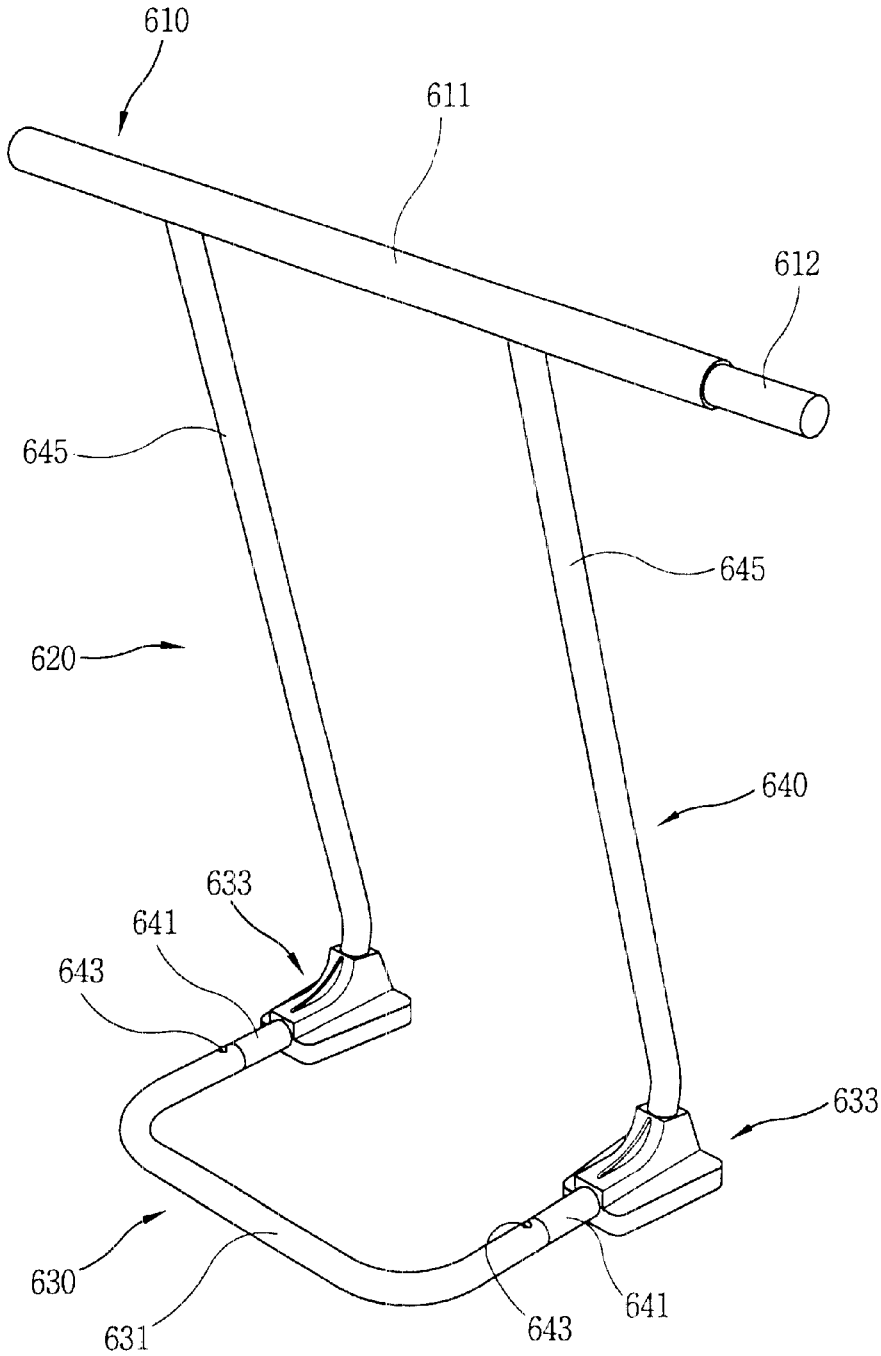
Figure 30:
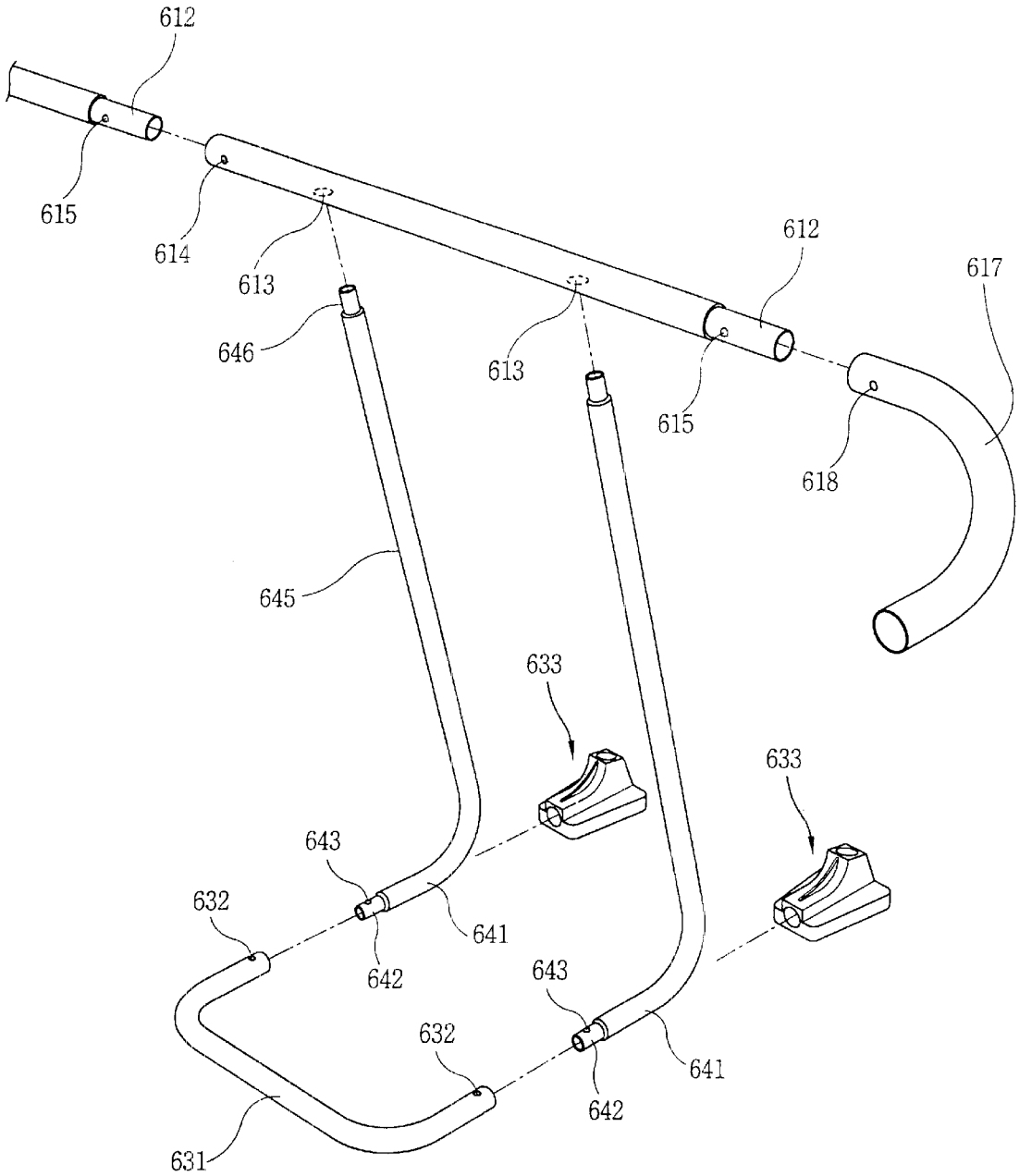
Figure 31:
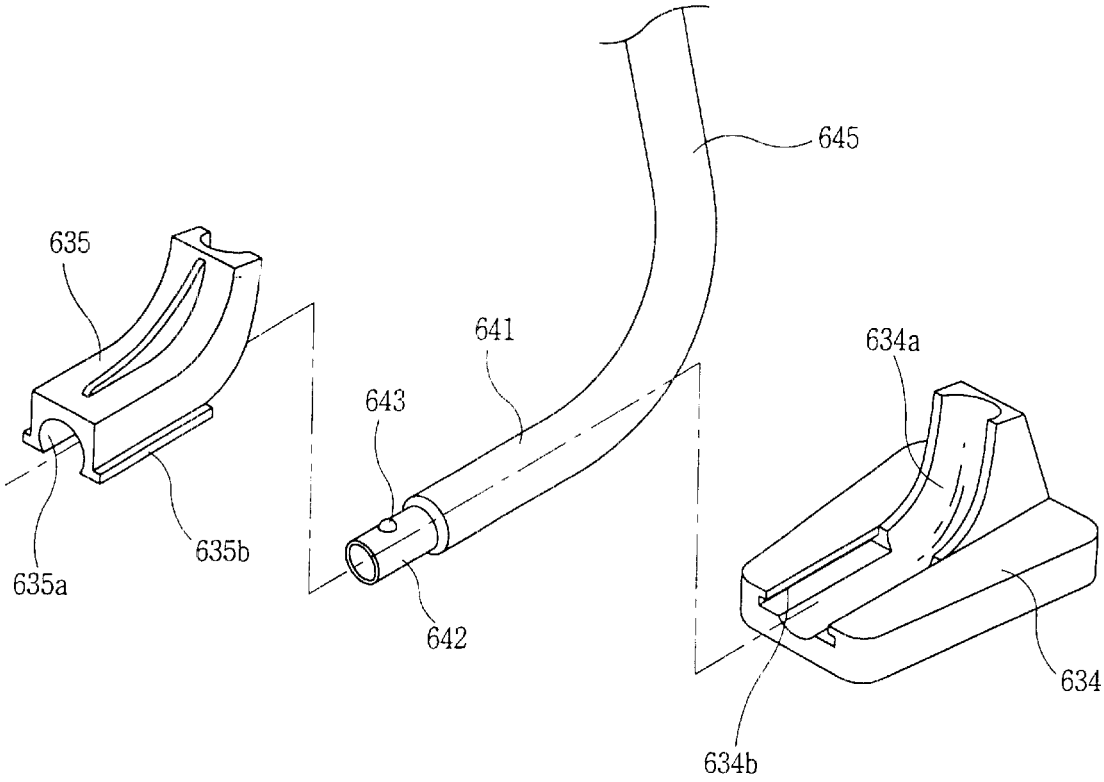
Figure 32:
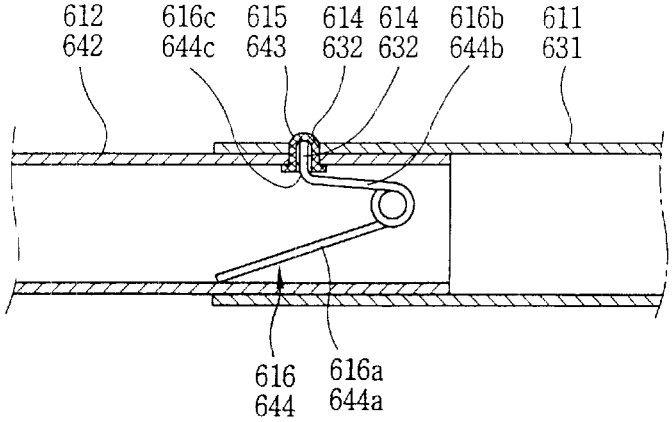

FIGS. 27 through 32 illustrate a prefabricated swimming pool in accordance with a seventh embodiment of the present invention, of which FIG. 27 is a perspective view of an overall assembly; FIG. 28 is a partial enlarged perspective view of FIG. 27; FIG. 29 is a partial disassembled perspective view of a pool frame; FIG. 30 is a partial disassembled front view of the pool frame; FIG. 31 is a partial disassembled perspective view of a vertical frame and FIG. 32 is a partial enlarged sectional view showing an assembled state of a horizontal frame, the vertical frame and the support unit.

In the drawings, reference numeral 500 denotes a pool body, and 600 denotes a pool frame for supporting the pool body 500.

The pool body 500 includes a base unit 510, and a circumferential side wall 520 upwardly extended from the marginal portion of the base unit 310.

A material for the pool body 500 is the same as that of the fifth and sixth embodiments.

The base unit 510 is adhered onto the ground where the prefabricated swimming pool in accordance with the present invention, limiting the area of the swimming pool. In the present invention, the base unit 510 is formed in a rectangular shape.

With reference to FIG. 28, a combining piece 511 is attached to the base unit 510, to be combined with the support part 630 of the vertical frame 620 (to be described).

A pocket 521 is formed at the upper end portion of the circumferential side wall 520, and an opening portion 522 is formed at the corner.

Through holes 523 are formed at the pocket 521 into which the upper end of the vertical frame 620 is penetrated.

Likewise in the above stated embodiments of the present invention, a drain tube (not shown) and a drain valve (not shown) may be installed to drain water filled in the swimming pool.

The pool frame 600 includes a horizontal frame 610 inserted into the pocket 521 to maintain a contour of the upper end portion of the pool body 500, and a plurality of vertical frames 620 for supporting the horizontal frame 610.

The horizontal frame 610 includes a plurality of horizontal bars 611 and corner connection bars 617 for connecting the horizontal bars 611 at the corner portions.

At both end portions of the horizontal bar 611, a combining hole 613 is formed into which the combining portion 646 of the vertical frame 620 (to be described) is inserted.

In order to detachably combine one end and the other end of the adjacent horizontal bars 611, a connection portion 612 having a smaller diameter than that of the horizontal bar 611 is formed at one end of the horizontal bar 611, so that the connection portion 612 is insertedly combined with the end portion of its counterpart by a medium force between the slide fitting and a tight fitting. In this respect, as shown in FIG. 32, it is preferred that a fixing hole 614 is formed at the other end of the horizontal bar 611 and a fixing protrusion 615 is elastically protruded at the connection portion 612, corresponding to the fixing hole 614, so that when the connection portion 612 is inserted into the other end of the horizontal bar 611, the fixing protrusion 615 is elastically pushed down, and then, when the fixing protrusion 615 is positioned at the fixing hole 614, it is elastically protruded to be inserted into the fixing hole 614. The both horizontal bars 611 are separated by being pulled in both directions while the fixing protrusion 615 is being pressed down.

In order to render the fixing protrusion 615 to be elastically protruded, an elastic member 616 is installed inside the connection portion 612, so as to elastically support the fixing protrusion 615.

As the elastic member 616, a compressive coil spring may be used. Yet, as shown in FIG. 32, in order to facilitate assembling, it is preferred to use a torsion spring consisting of a fixing support portion 616*a* supported by the inner circumferential surface of the connection portion 612 and an elastic support portion 616*b* supporting the fixing protrusion 615.

In order to prevent an arbitrary separation between the fixing protrusion 615 and the elastic support portion 616*b*, preferably, a fixing groove 615*a* is formed at the bottom of the fixing protrusion 615 and an insertion-fixing portion 616*c* is formed bent at the elastic support portion 616*b* so as to be insertedly fixed at the fixing groove 615*a*.

At both end portions of the corner connection bar 617, a fixing hole 618 is formed into which the fixing protrusion 615 is inserted.

As shown in FIG. 28, the vertical frame 620 includes a support part 630 placed on the ground, and a pair of vertical parts 640 upwardly extended from the outer end of the support part 630, its upper end being combined with the horizontal frame 610.

The support part 630 consists of a support bar 631 formed roughly in a channel shape, and a support piece 633 combined with the lower bent portion of the vertical part 640.

The vertical part 640 consists of a ground bar 641 combined with the outer end of the support bar 631 and extended horizontally, and a vertical bar 645 upwardly extended from the outer end of the ground bar 641, of which upper end is combined with the horizontal bar 611.

In order to detachably combine the outer end of the support bar 631 and the inner end of the ground bar 641, a connector 642 having a smaller diameter than that of the ground bar 641 may be formed at the inner end of the ground bar 641 and insertedly combined with the outer end of the support bar 631 by a medium force between slide fitting and tight fitting.

In this respect, as shown in FIG. 32, it is preferred that a fixing hole 632 is formed at the outer end of the support bar 631 and a fixing protrusion 643 is installed to be elastically protruded at the connection portion 642, corresponding to the fixing hole 632, so that when the connection portion 642 is inserted into the outer end of the support bar 631, the fixing protrusion 643 is elastically pushed down, and then, when the fixing protrusion 615 is positioned at the fixing hole 632, it is elastically protruded to be inserted into the fixing hole 632. The support bar 631 and the ground bar 641 are separated by being pulled in the opposite direction while the fixing protrusion 643 is being pressed down.

In order to render the fixing protrusion 643 to be elastically protruded, an elastic member 644 is installed inside the connection portion 642, so as to elastically support the fixing protrusion 643.

As the elastic member 616, a compressive coil spring may be used. Yet, as shown in FIG. 32, in order to facilitate assembling, it is preferred to use a torsion spring consisting of a fixing support portion 644*a* supported by the inner circumferential surface of the connection portion 642 and an elastic support portion 644*b* supporting the fixing protrusion 643.

In order to prevent an arbitrary separation between the fixing protrusion 643 and the elastic support portion 644*b*, preferably, a fixing groove 643*a* is formed at the bottom of the fixing protrusion 643 and an insertion-fixing portion 644*c* is formed bent at the elastic support portion 644*b* so as to be insertedly fixed at the fixing groove 643*a*.

FIG. 32 shows the connection structure of the horizontal bar 611 of the horizontal frame 610 as well as the combining structure of the support part 630 of the vertical frame 620 and the vertical part 640.

The vertical bar 645 is formed to be inwardly inclined as it goes upward.

A combining portion 646 is formed at the upper end of the vertical bar 645, having a smaller diameter than that of the vertical bar 645 so as to be inserted into the combining hole 613 formed on the horizontal bar 611.

With reference to FIG. 31, fabricated from a synthetic resin, the support piece 633 consists of a lower piece 634 with wide bottom including a combining groove 634*a* to which the boundary portion between the ground bar 641 and the vertical bar 645 is inserted, and an upper piece 635 combined with the lower piece 634, including an insertion groove 635*a* to which the boundary portion between the ground bar 641 and the vertical bar 645 is inserted.

The lower piece 634 and the upper piece 635 may be combined by bonding, fusing or by using a screw. In this respect, as shown in FIG. 31, it is preferred that by forming a combining groove 634*b* at the lower piece 634 and a combining protrusion 635*b* at the upper piece 635, they are simply combined by inserting the combining protrusion 635*b* into the combining groove 634*b*.

Assembling of the pool body 500 and the pool frame 600 is as follows. The support bar 631 is insertedly combined with the combining piece 511 attached onto the base unit 510, and the support bar 631 is combined with the ground bar 641. In this state, the vertical frame 620 is assembled and the plurality of vertical frames 620 are disposed to stand on the ground, and then the pool body 500 is unfolded inside the vertical frames 620. And, the horizontal frame 410 is assembled in a manner that after the horizontal bars 611 are coupled and respectively inserted into the pockets 521 of four sides through the opening portions 522 formed at the corner portions, the horizontal bars 511 inserted in the pockets 521 of each side are connected by the corner connection bars 617. Thereafter, the combining portion 646 formed at the upper end of the vertical bar 645 is inserted into the combining hole 613 formed on the horizontal bar 611 through the through hole 523 formed at the pocket 521, to thereby combine the horizontal frame 610 and the vertical frame 620. Then, the circumferential side wall 520 of the pool body 500 is stood, forming the figure of the pool body 600.

In this state, when water is put in the pool body 500, the base unit 510 of the pool body 300 is adhered onto the ground due to the water pressure, becoming flat, while the circumferential side wall 520 is inflated outwardly, maintaining a tight state, which is suitable to use as a swimming pool.

At this time, the water pressure applied to the circumferential side wall 520 is transferred through the upper horizontal frame 610 to the vertical frame 620. In this respect, since the vertical bar 645 constructing the vertical frame 620 is formed with its upper end inwardly inclined, so that there is no possibility that the pool body is inclined outwardly or collapses, compared to a pool body of which vertical frames are formed stood completely vertical. Thusly, a stable state of the pool body can be maintained.

After finishing using the prefabricated swimming pool in accordance with the embodiment of the present invention, when it is desired to be disassembled for storing or carrying, a drain valve (not shown) installed at the circumferential side wall 520 of the pool body 500 is opened to drain the water through a drain tube (not shown), and then the swimming pool is disassembled in the reverse order of the assembling.

As so far described, according to the prefabricated swimming pool of the present invention, since the pool frame and the pool body are constructed to be able to be disassembled, storing and carrying of it is very simple. In addition, since the pool body is supported by the pool frame, there is no possibility that the circumferential side wall is inclined or collapses, so that it can be used safely and reliably.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A prefabricated swimming pool comprising:

a pool body comprising:

a base unit, a circumferential side wall upwardly extended from a marginal portion of the base unit, and a plurality of pockets formed at the upper end of the circumferential side wall, the pockets being divided by a plurality of opening portions; and a pool frame comprising:

a horizontal frame consisting of a plurality of horizontal bars inserted into the pockets and a plurality of connection bars for connecting the adjacent horizontal bars, and a plurality of vertical frames each consisting of a support unit placed on the ground at the exterior of the circumferential side wall and a pair of vertical bars for connecting the support unit and the corresponding horizontal bar through one of the opening portions for supporting the horizontal frame, wherein the support unit comprises:

a pair of side bars respectively being connected with, and extended toward the exterior of the circumferential side wall from the corresponding vertical bar, an inner bar connecting the ends of the pair of vertical bars, and an outer bar connecting the ends of the pair of side bars.

2. The prefabricated swimming pool of claim 1, wherein the vertical bars are convex toward the exterior of the circumferential side wall for supporting the circumferential side wall.

3. The prefabricated swimming pool of claim 1, wherein a reinforcing plate is installed between the vertical bars and the side bars.

4. A prefabricated swimming pool comprising:

a pool body comprising:

a base unit, a circumferential side wall upwardly extended from a marginal portion of the base unit, and a plurality of pockets formed at the upper end of the circumferential side wall, the pockets being divided by a plurality of opening portions; and a pool frame comprising:

a horizontal frame consisting of a plurality of horizontal bars inserted into the pockets and a plurality of connection bars for connecting the adjacent horizontal bars, and a plurality of vertical frames each consisting of a support unit placed on the ground at the exterior of the circumferential side wall and a pair of vertical bars for connecting the support unit and the corresponding horizontal bar through one of the opening portions for supporting the horizontal frame, wherein the vertical bars are L-shaped, and the support unit has a U-shaped support bar connected to the ends of the pair of vertical bars.

5. The prefabricated swimming pool of claim 4, wherein the base unit has a plurality of combining pieces through which the corresponding support bar is inserted.

6. The prefabricated swimming pool of claim 4, wherein the support unit further comprises a support piece including a lower piece which is formed with a combining groove to which a bent portion of the vertical bar is inserted and placed on the ground, and an upper piece combined with the lower piece, including an insertion groove to which the bent portion of the vertical bar is inserted.

7. The prefabricated swimming pool of claim 6, wherein the upper piece and the lower piece are combined by the combination of a combining protrusion and a combining groove formed thereon.

8. A pool frame for a prefabricated swimming pool comprising:

a horizontal frame including a plurality of horizontal bars and a plurality of connection bars for connecting the adjacent horizontal bars;

a plurality of pairs of vertical bars respectively supporting the horizontal bars and arranged in a slanted direction with respect to the ground;

a plurality of support units respectively connected with each corresponding pair of vertical bars and placed on the ground, wherein said pairs of vertical bars are connected with the corresponding horizontal bar and bent to form a part of the support unit; and a support piece including a lower piece which is formed with a combining groove to which a bent portion of the vertical bar is inserted and placed on the ground, and an upper piece combined with the lower piece, including an insertion groove to which the bent portion of the vertical bar is inserted.

* * * * *